US008439488B2

(12) United States Patent
Nakamura et al.

(10) Patent No.: US 8,439,488 B2
(45) Date of Patent: May 14, 2013

(54) INK SUPPLY DEVICE

(75) Inventors: Hirotake Nakamura, Nagoya (JP); Shingo Hattori, Nagoya (JP)

(73) Assignee: Brother Kogyo Kabushiki Kaisha, Aichi-ken (JP)

( * ) Notice: Subject to any disclaimer, the term of this patent is extended or adjusted under 35 U.S.C. 154(b) by 1062 days.

(21) Appl. No.: 12/323,660

(22) Filed: Nov. 26, 2008

(65) Prior Publication Data

US 2009/0135237 A1 May 28, 2009

(30) Foreign Application Priority Data

Nov. 28, 2007 (JP) ..... 2007-307901
Dec. 1, 2007 (JP) ..... 2007-311819

(51) Int. Cl.
*B41J 2/175* (2006.01)

(52) U.S. Cl.
USPC ..... 347/85; 101/333

(58) Field of Classification Search ..... 347/85; 101/333
See application file for complete search history.

(56) References Cited

U.S. PATENT DOCUMENTS

| | | | | |
|---|---|---|---|---|
| 3,804,016 | A * | 4/1974 | Marozzi et al. | 101/333 |
| 4,145,967 | A * | 3/1979 | Marozzi | 101/333 |
| 4,844,640 | A * | 7/1989 | Ganz | 401/116 |
| 5,512,926 | A * | 4/1996 | Uchikata et al. | 347/86 |
| 6,142,602 | A * | 11/2000 | Tanaka | 347/29 |
| 6,250,750 | B1 * | 6/2001 | Miyazawa et al. | 347/87 |
| 6,456,392 | B1 * | 9/2002 | Asano | 358/1.2 |
| 6,520,625 | B1 * | 2/2003 | Kawakami | 347/49 |
| 7,188,939 | B1 * | 3/2007 | Sasaki | 347/86 |
| 7,416,290 | B2 * | 8/2008 | Hattori et al. | 347/86 |
| 7,806,523 | B2 * | 10/2010 | Seino et al. | 347/86 |
| 8,007,091 | B2 * | 8/2011 | Nakamura et al. | 347/86 |
| 8,025,376 | B2 * | 9/2011 | Hattori et al. | 347/86 |
| 2005/0157110 | A1 * | 7/2005 | Silverbrook | 347/86 |
| 2005/0168545 | A1 * | 8/2005 | Sakai et al. | 347/86 |
| 2005/0185036 | A1 * | 8/2005 | Seino et al. | 347/86 |
| 2006/0164480 | A1 | 7/2006 | Harada et al. | |
| 2006/0203051 | A1 * | 9/2006 | Kanbe | 347/86 |
| 2007/0070146 | A1 * | 3/2007 | Hattori et al. | 347/86 |
| 2007/0229615 | A1 * | 10/2007 | Hattori et al. | 347/86 |
| 2008/0180496 | A1 * | 7/2008 | Hattori et al. | 347/86 |

FOREIGN PATENT DOCUMENTS

| | | |
|---|---|---|
| JP | 10-250103 | 9/1998 |
| JP | 10250103 A * | 9/1998 |

(Continued)

OTHER PUBLICATIONS

Notification of Reasons for Refusal for Japanese Application No. 2007-311819 dated May 29, 2012.

*Primary Examiner* — Charlie Peng
*Assistant Examiner* — Peter Radkowski
(74) *Attorney, Agent, or Firm* — Frommer Lawrence & Haug LLP

(57) ABSTRACT

An ink supply device including an ink cartridge for storing an ink; a mounting portion which includes an opening from which the ink cartridge is removable in a direction; an elastic member which urges the ink cartridge accommodated in the mounting portion to the direction; and a lock member. The lock member includes a lock arm including an operating lever provided at a first end thereof, and a lock portion provided at a second end thereof; a supporting mechanism which movably supports the lock arm between a first posture in which the lock portion is disengaged from the engaged portion and a second posture in which the lock portion is engaged with the engaged portion to regulate a movement of the ink cartridge to the direction; and a stopper which is provided in the lock arm and contacts the ink cartridge when the lock arm takes the first posture.

13 Claims, 10 Drawing Sheets

FOREIGN PATENT DOCUMENTS

| | | | |
|---|---|---|---|
| JP | 2006-326950 | | 12/2006 |
| JP | 2006326950 | A * | 12/2006 |
| JP | 2007-196653 | | 8/2007 |
| JP | 2007196653 | | 8/2007 |
| WO | WO 03103973 | | 12/2003 |
| WO | WO 2007/037548 | | 4/2007 |

* cited by examiner

INK SUPPLY DEVICE

CROSS-REFERENCE TO RELATED APPLICATION

This application claims priority from Japanese Patent Application Nos. 2007-307901 filed on Nov. 28, 2007 and 2007-311819 filed on Dec. 1, 2008, the subject matter of which is incorporated herein by reference in its entirety.

TECHNICAL FIELD

Aspects of the present invention relate to an ink supply device including an ink cartridge that can be inserted into or removed from a cartridge mounting portion in two directions, and a lock member that locks the ink cartridge inserted into the cartridge mounting portion, and an ink supply device in which an ink cartridge inserted into the cartridge mounting portion is removed by an urging force of an elastic member.

BACKGROUND

An image recording apparatus uses ink to record images on a recording sheet (recording medium). The image recording apparatus includes an ink-jet recording head, and selectively discharges ink droplets onto the recording sheet from the nozzles of the recording head. The ink droplets are dropped on the recording sheet, and a desired image is recorded on the recording sheet. The image recording apparatus is provided with an ink container that stores ink to be supplied to the recording head. The ink container is generally a cartridge type, and can be inserted into or removed from a cartridge mounting portion provided in the image recording apparatus. The cartridge-type ink container is also called an ink cartridge. When no ink in the ink cartridge remains, the ink cartridge is removed from the cartridge mounting portion of the image recording apparatus, and a new ink cartridge having ink stored therein is inserted into the cartridge mounting portion. The image recording apparatus in which the ink cartridge can be inserted into or removed from the cartridge mounting portion has a configuration that positions the ink cartridge or locks the inserted state of the ink cartridge.

IP-A-2007-196653 describes a configuration in which, when an ink cartridge 14 is inserted into a refill unit 13 and a door 41 is closed, a pressure holding member 61 comes into contact with a pressing portion 200*a*, which is a portion of the rear surface of the ink cartridge 14, the ink cartridge 14 is held by the urging force of a coil spring 66 of the pressure holding member 61. The ink cartridge 14 is taken out from the refill unit 13 by a drawing member 65 provided in the door 41 when the door 41 is disposed at an opened position.

The ink cartridge 14 includes an ink storage 100 that stores ink and a case 200 that covers substantially the entire ink storage 100.

The ink cartridge 14 is provided with a supply valve 620. The supply valve 620 is opened when an ink needle 49 provided in a multi-function apparatus 1 is inserted thereinto. When the supply valve 620 is opened, the ink stored in the ink storage 100 is supplied to the multi-function apparatus 1 through the ink needle 49.

However, in the configuration described in JP-A-2007-196653, it is difficult to increase the rotation range of the drawing member 65 with respect to the displacement of the door 41, and it is also difficult to sufficiently take out the ink cartridge 14 from the refill unit 13 by the opening operation of the door 41. Therefore, it is difficult for the user to hold the ink cartridge 14 to be replaced from both sides.

For examples in a configuration in which a coil spring that urges the ink cartridge 14 inserted into the refill unit 13 in the removal direction is provided in the refill unit 13, when the door 41 is opened, it is possible to spring out the ink cartridge 14 from the refill unit 13 using the urging force of the coil spring. However, when ink in the ink cartridge is consumed and the weight of the ink cartridge is reduced, it is difficult to accurately control the spring-out of the ink cartridge 14. When ink in the ink cartridge 14 is consumed and the weight of the ink cartridge 14 is reduced, the ink cartridge 14 is forcibly sprung out from the refill unit 13 by the urging force. As a result ink droplets adhered to the supply valve 620 or the ink needle 49 are scattered, and the outer wall of the refill unit 13 or the ink cartridge 14 is smeared with ink.

Additionally, it is preferable that the ink cartridge 14 be replaced as simple as possible.

Further, it is preferable to simplify the configuration of the refill unit 13 in order to reduce the manufacturing costs and the size thereof.

SUMMARY

Exemplary embodiments of the present invention address the above disadvantages and other disadvantages not described above. However, the present invention is not required to overcome the disadvantages described above, and thus, an exemplary embodiment of the present invention may not overcome any of the problems described above.

Accordingly, it is an aspect of the present invention to provide a mechanism capable of accurately controlling the spring-out of an ink cartridge from a cartridge mounting portion.

It is another aspect of the present invention to provide a mechanism which allows simultaneously performing an operation of unlocking an ink cartridge inserted into a cartridge mounting portion and an operation of controlling the spring-out of the ink cartridge from the cartridge mounting portion.

Further, it is another aspect of the present invention to provide a mechanism capable of preventing an ink cartridge from being forcibly sprung out from a cartridge mounting portion by the urging force of an elastic member in a removal direction.

According to an exemplary embodiment of the present invention, there is provided an ink supply device including: an ink cartridge which includes an ink chamber for storing ink and an engaged portion; a cartridge mounting portion which includes an opening through which the ink cartridge is insertable in a first direction and removable in a second direction and which is configured to accommodate therein the ink cartridge; a first elastic member which urges the ink cartridge accommodated in the cartridge mounting portion to the second direction; and a look member which is engaged with the engaged portion of the ink cartridge accommodated in the cartridge mounting portion to regulate a movement of the ink cartridge to the second direction. The lock member includes: a lock arm including an operating lever provided at a first end thereof and a lock portion provided at a second end thereof and being engaged with the engaged portion; a supporting mechanism which movably supports the lock arm between a first posture in which the lock portion is disengaged from the engaged portion and a second posture in which the lock portion is engaged with the engaged portion; and a stopper which is provided in the lock arm and contacts the ink cartridge moved in the first direction by the first elastic member when the lock am takes the first posture.

According to another exemplary embodiment of the present invention, there is provided an ink supply device including: an ink cartridge which includes an ink chamber for storing ink, an engaged portion; and a friction member; a cartridge mounting portion to which the ink cartridge is removably inserted and configured to accommodate therein the ink cartridge; a contact member which is provided in the cartridge mounting portion, and which comes into slide contact with the friction member of the ink cartridge inserted into the cartridge mounting portion so that the ink cartridge is movable in a removal direction; an elastic member which urges the ink cartridge inserted into the cartridge mounting portion to the removal direction; and a lock member which is movable between a first posture in which the ink cartridge inserted into the cartridge mounting portion is removable in the removal direction and a second posture in which the lock member is engaged with the engaged portion to regulate a movement of the ink cartridge to the removal direction against an urging force of the elastic member. The friction member generates a sliding friction with the contact member of the cartridge mounting portion.

According to another exemplary embodiment of the present invention, there is provided an ink cartridge accommodating device including: a cartridge accommodating portion to which an ink cartridge is removably inserted, the ink cartridge including an engaged portion; and a lock member. The lock member includes: a shaft; a lock arm rotatably supported by the shaft, the lock arm including a lock portion and a stopper. The lock arm is rotatable between a first posture in which the lock portion is disengaged from the engaged portion and the stopper contacts a portion of the ink cartridge and a second posture in which the lock portion is engaged with the engaged portion.

BRIEF DESCRIPTION OF THE DRAWINGS

The above and other aspects of the present invention will become more apparent and more readily appreciated from the following description of exemplary embodiments of the present invention taken in conjunction with the attached drawings, in which:

FIG. 2A is a perspective view illustrating a slider disposed at a first position, and FIG. 2B is a perspective view illustrating the slider disposed at a second position;

FIG. 3A is a side view illustrating the slider disposed at the first position, and FIG. 3B is a side view illustrating the slider disposed at the second position;

DETAILED DESCRIPTION

Hereinafter, illustrative non-limiting exemplary embodiments of the present invention will be described with reference to the accompanying drawings. It will be understood by those skilled in the art that various changes in form and details may be made therein without departing from the spirit and scope of the invention as defined by the appended claims.

[Description Of The Drawings]

Figure 1:
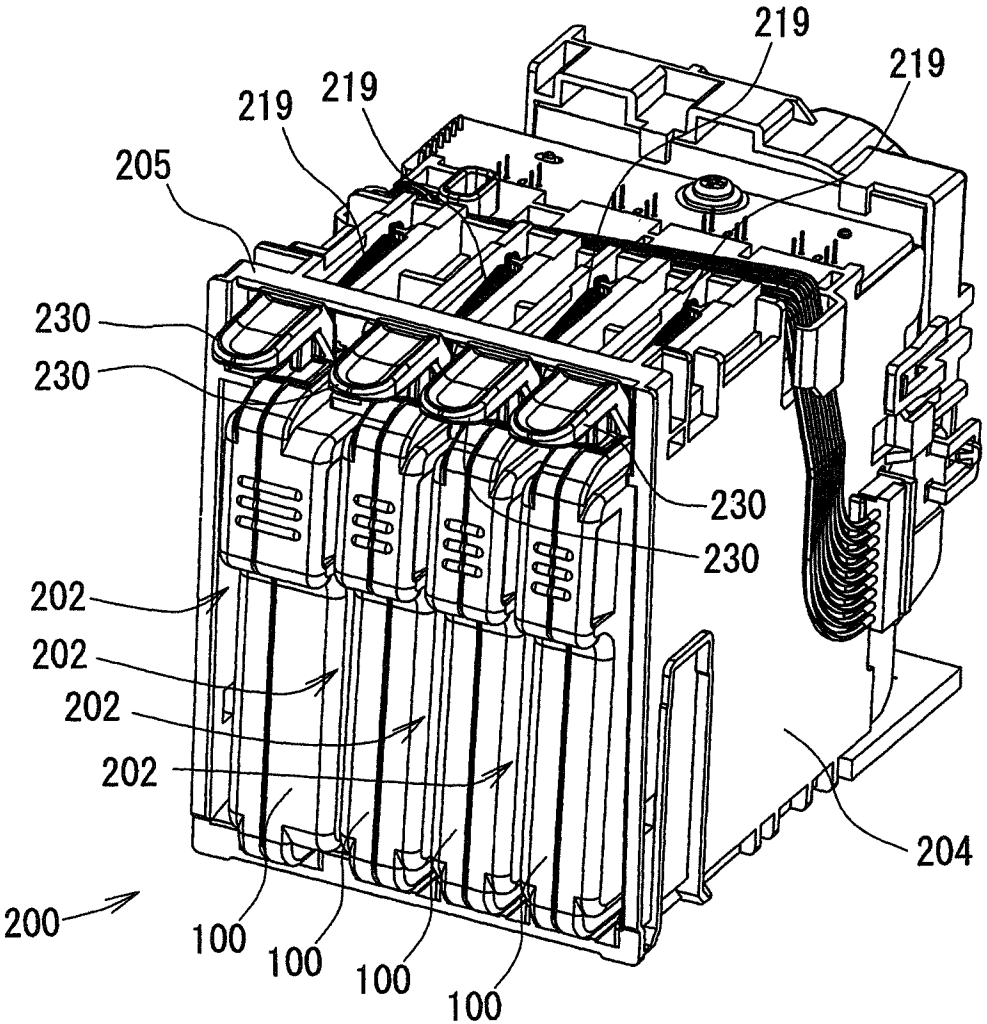
FIG. 1 is a perspective view illustrating the external configuration of an ink supply device having an ink cartridge inserted thereinto according to an exemplary embodiment.
Figure 2B:
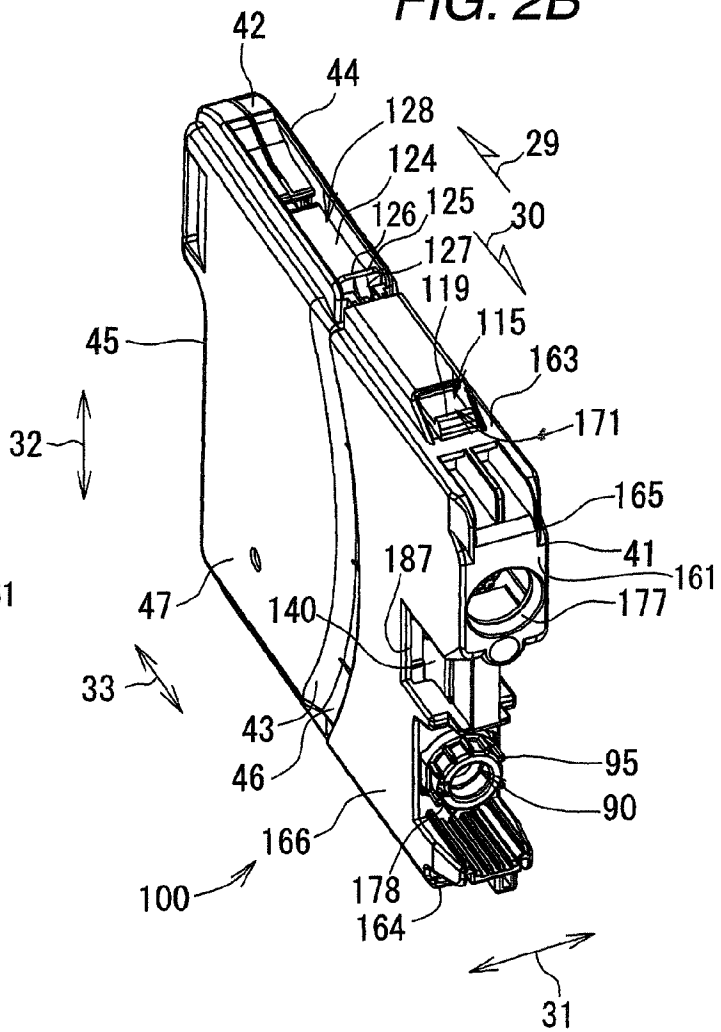
FIGS. 2A and 2B are perspective views illustrating the external configuration of the ink cartridge, specifically.
Figure 2A:
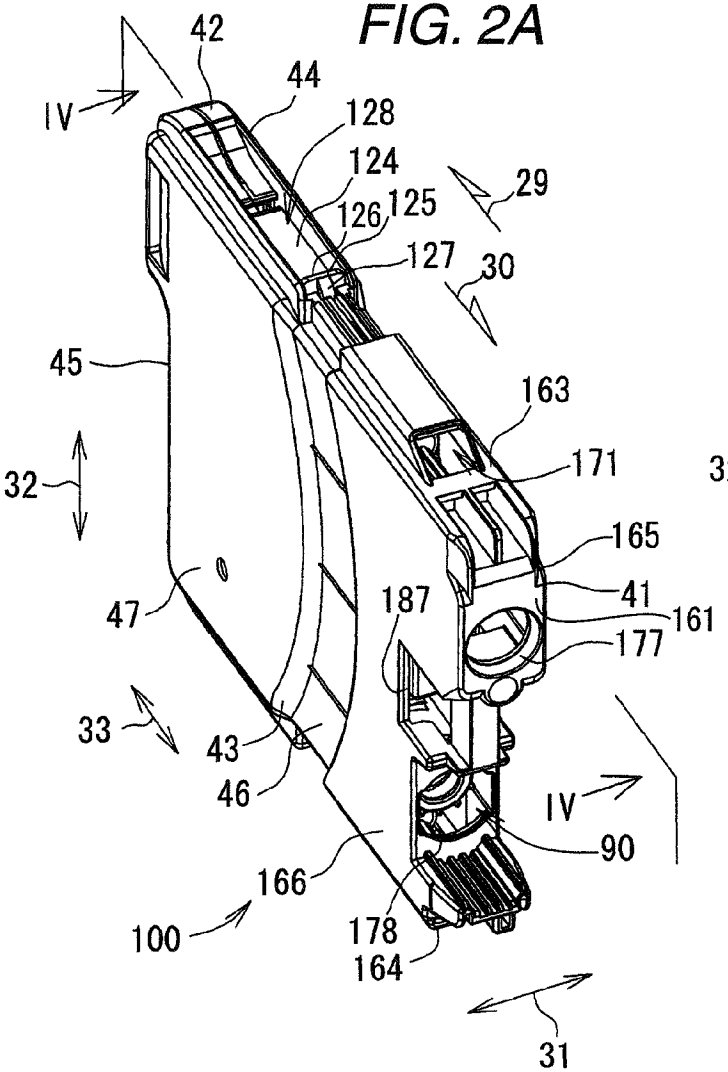
Figure 3A:
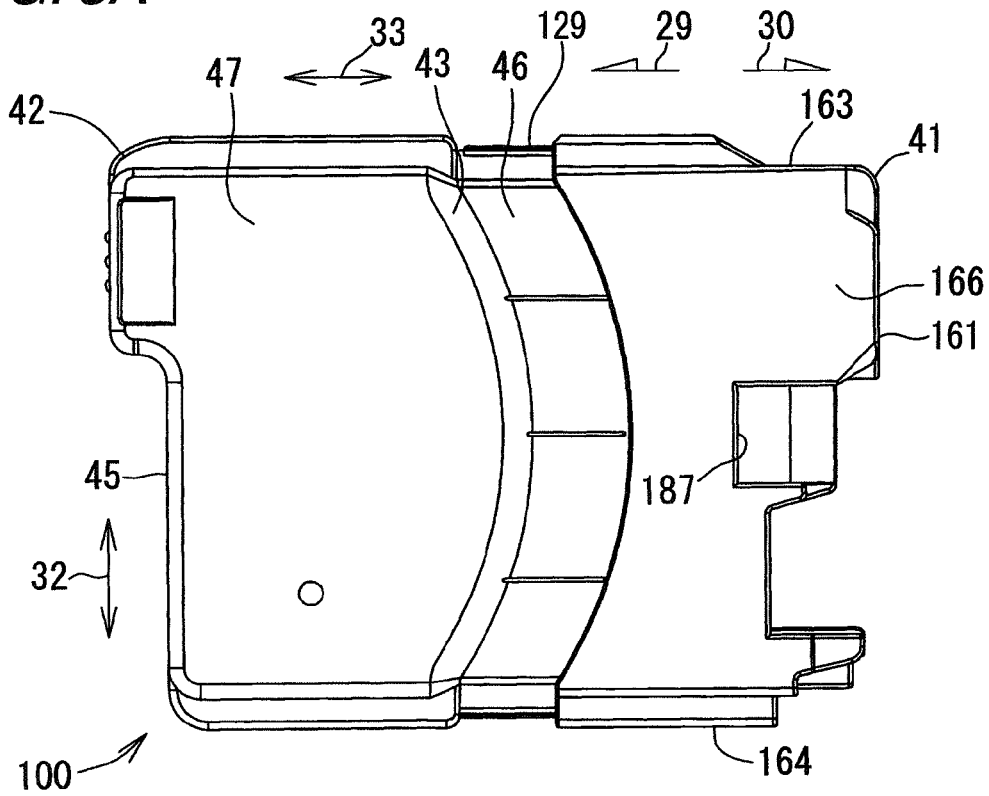
FIGS. 3A and 3B are side views illustrating the ink cartridge, specifically.
Figure 3B:
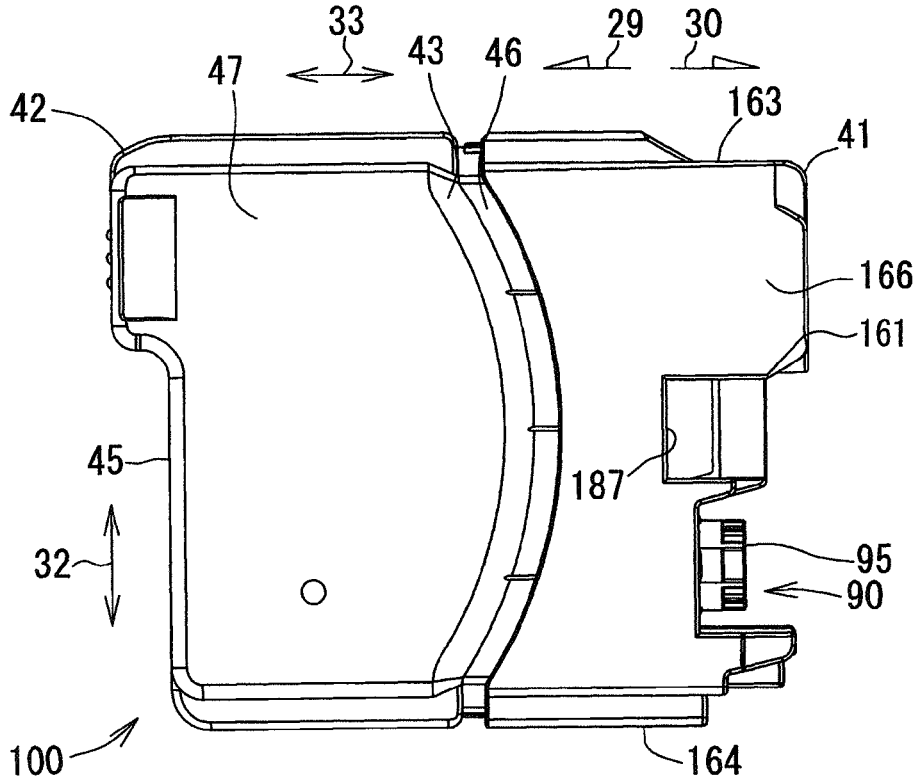
Figure 4:
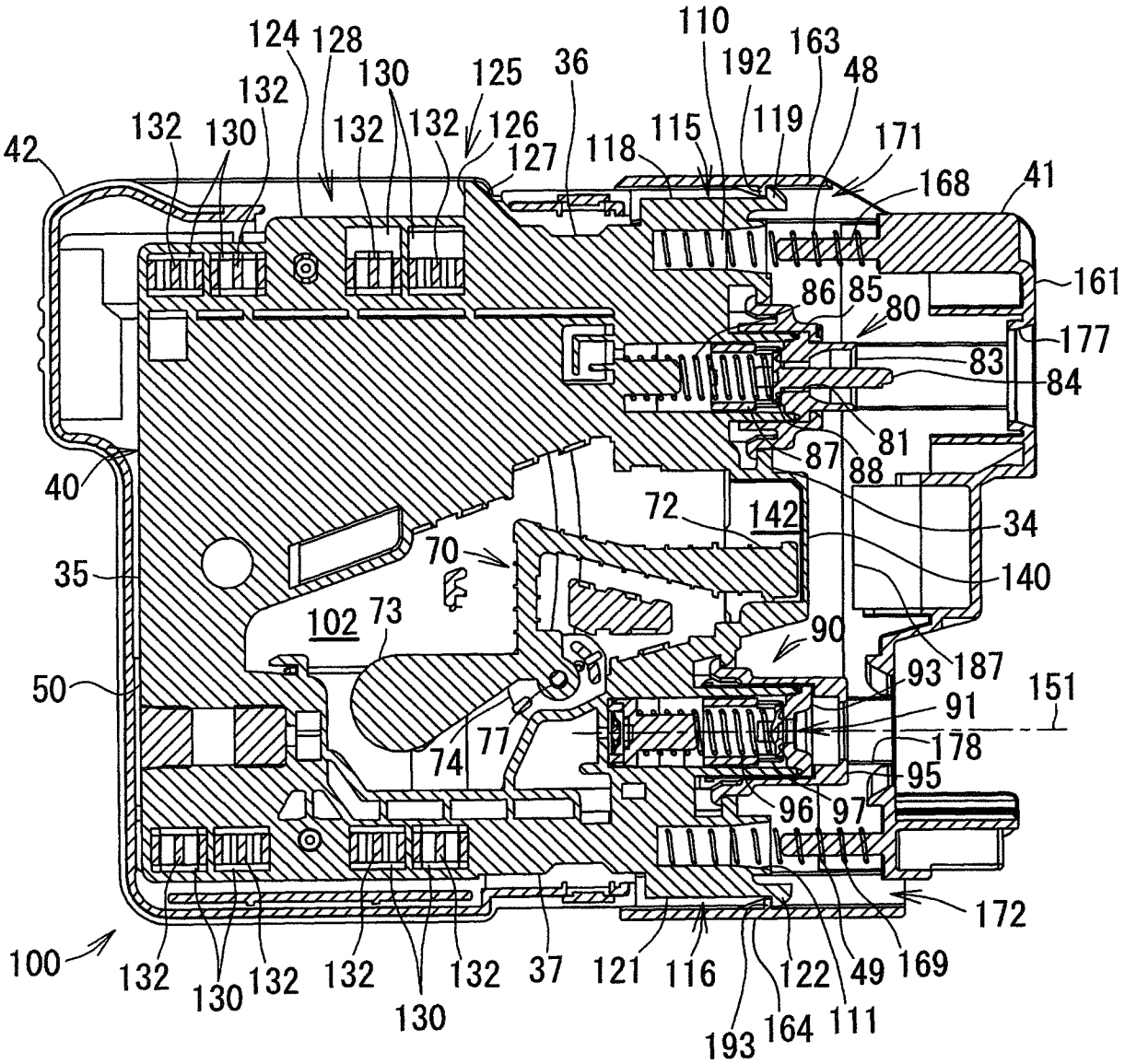
FIG. 4 is a cross-sectional view taken along the line IV-IV of FIG. 2A.
Figure 5:
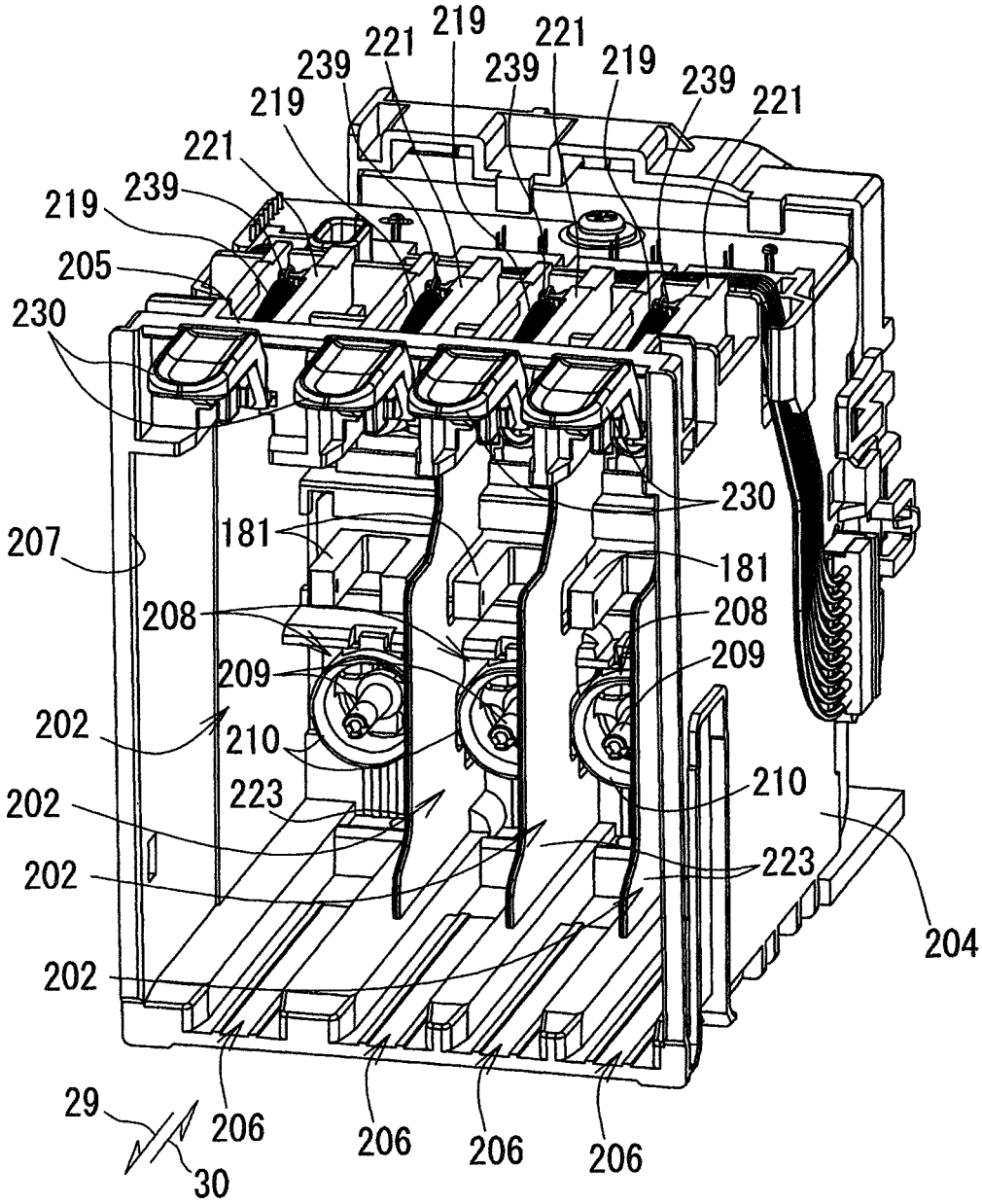
FIG. 5 is a perspective view illustrating the external configuration of a cartridge mounting portion according to an exemplary embodiment.
Figure 6:
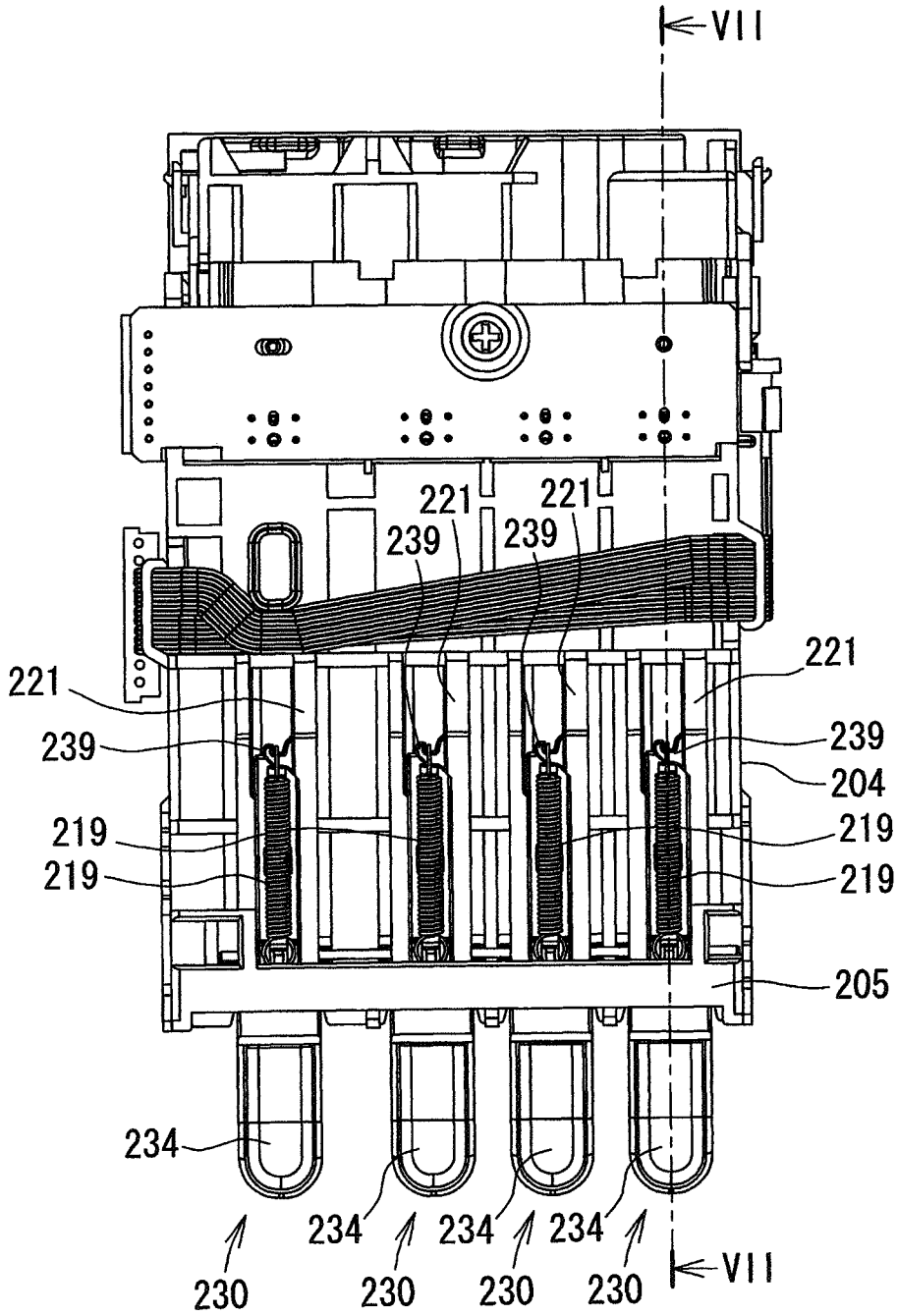
FIG. 6 is a plan view illustrating the external configuration of the cartridge mounting portion.
Figure 7:
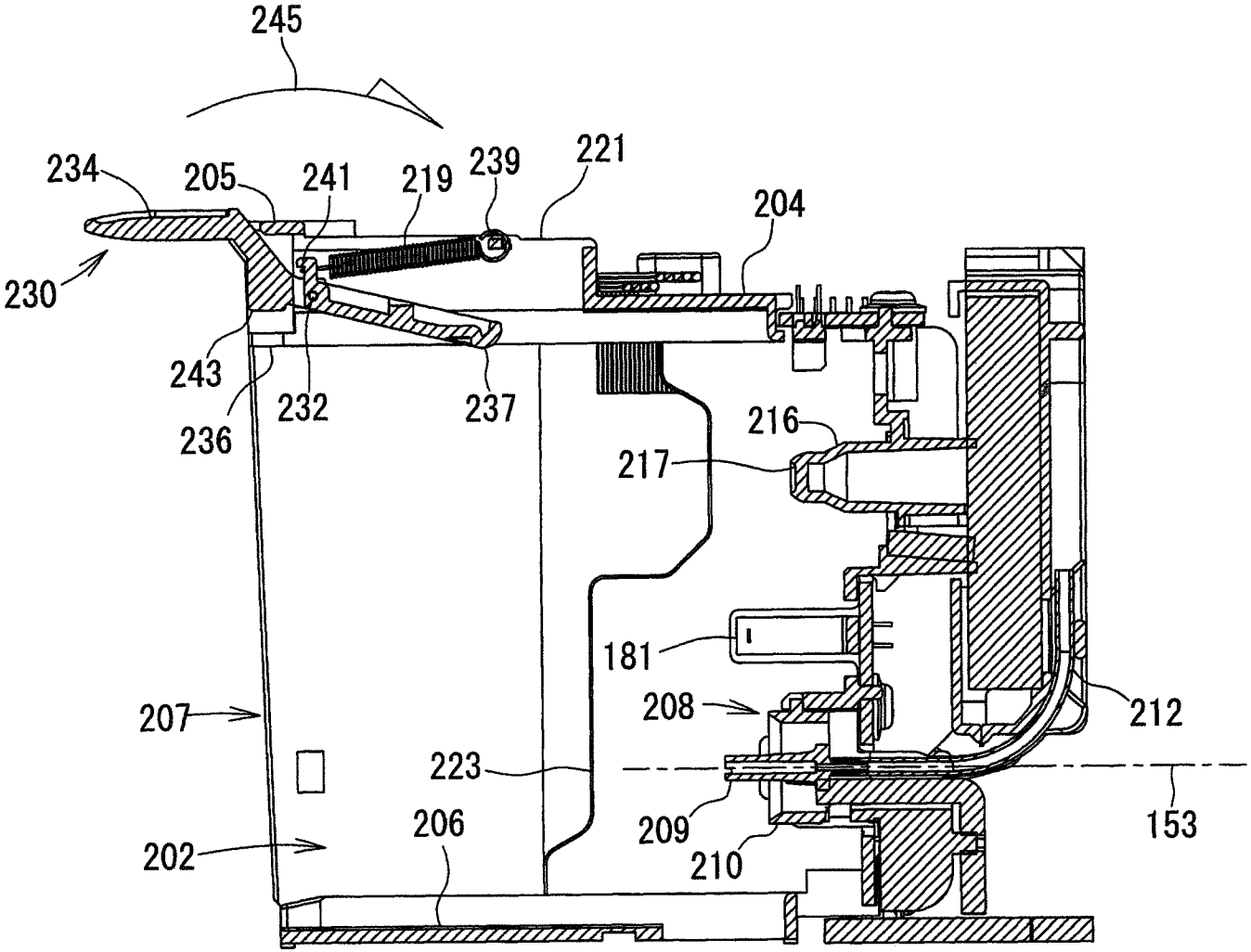
FIG. 7 is a cross-sectional view taken along the line VII-VII of FIG. 6.
Figure 8:
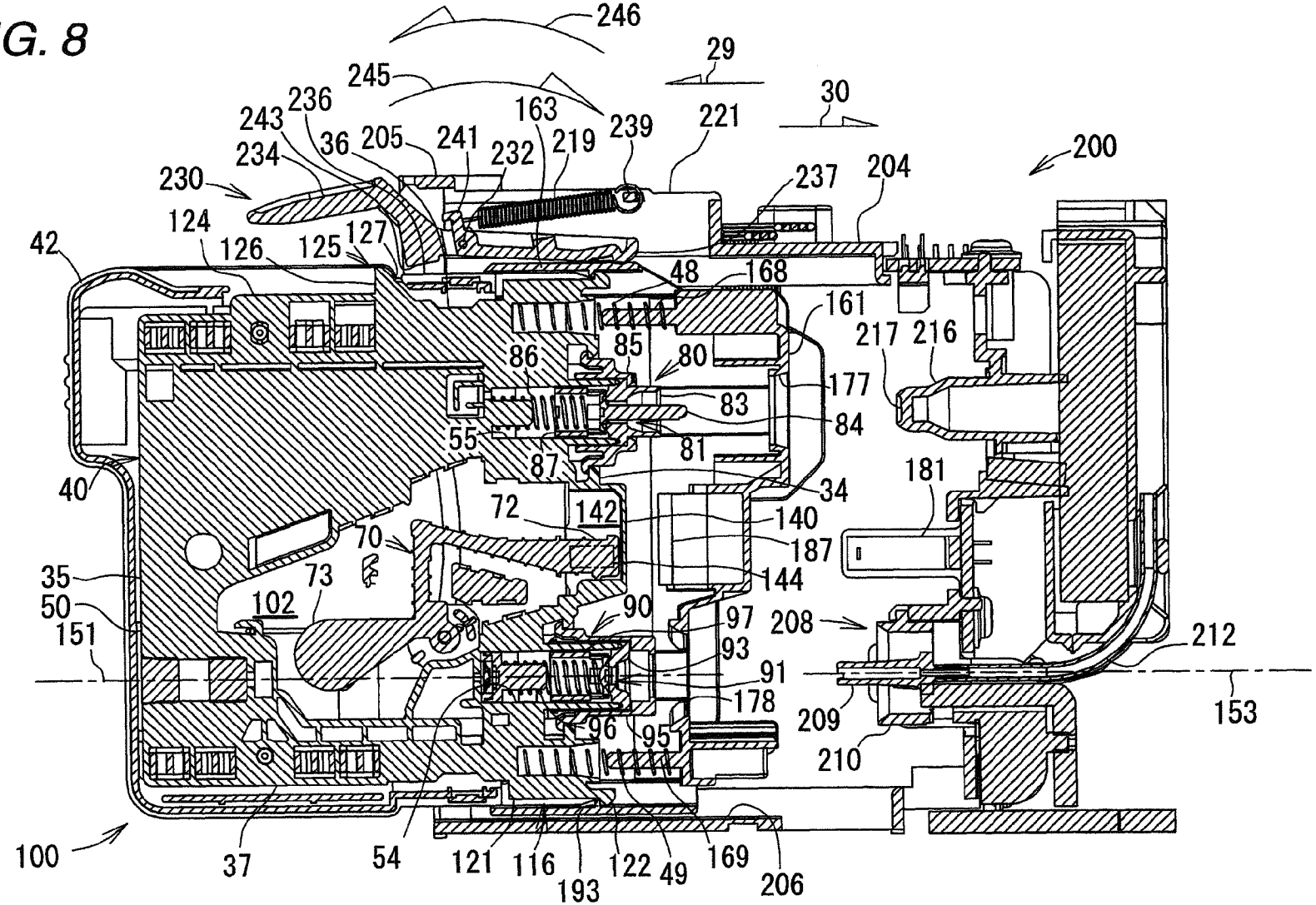
FIG. 8 is a cross-sectional view illustrating the insertion of the ink cartridge into the cartridge mounting portion taken along the line VII-VII.
Figure 9:
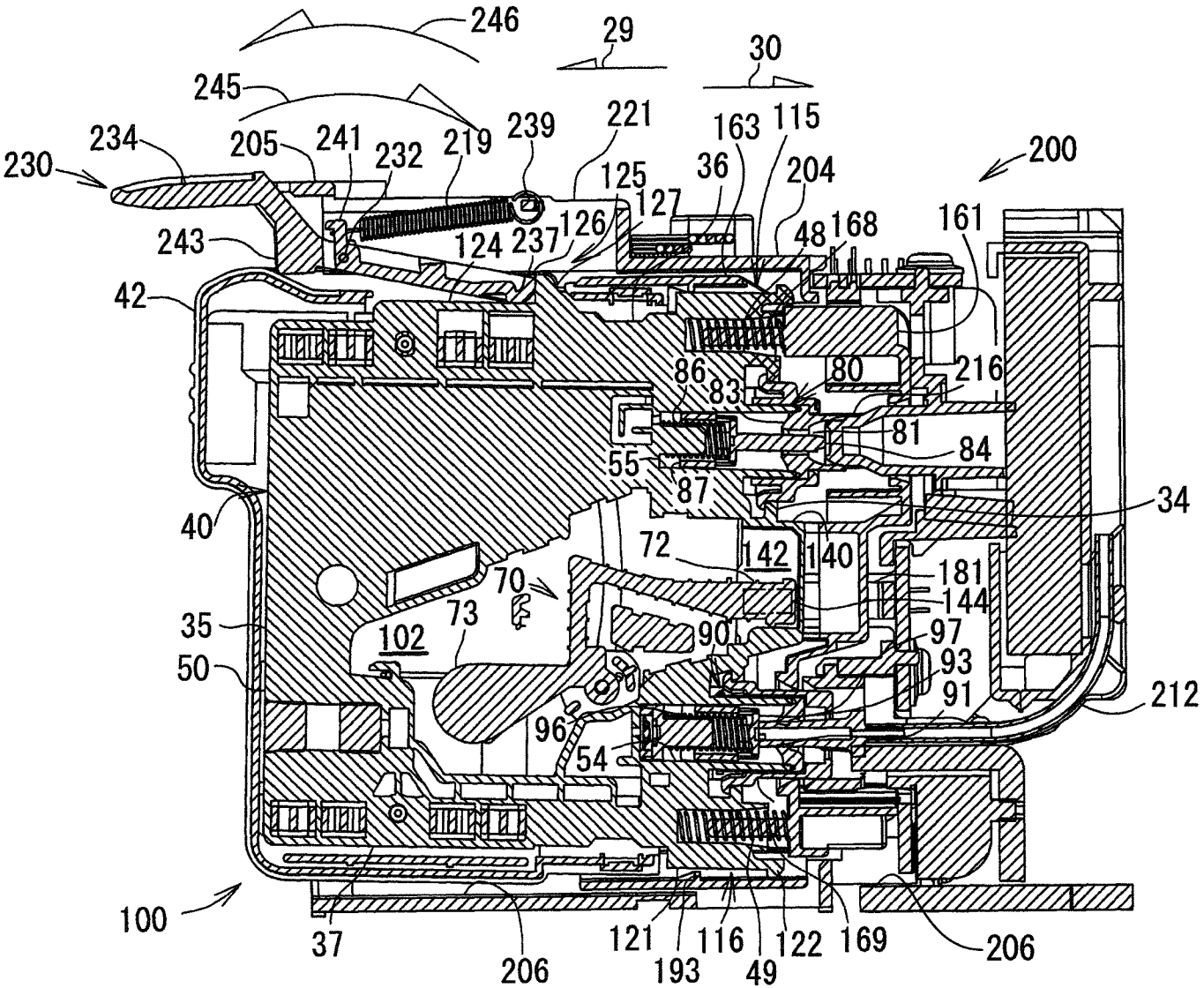
FIG. 9 is a cross-sectional view illustrating the ink cartridge inserted into the cartridge mounting portion taken along the line VII-VII.
Figure 10:
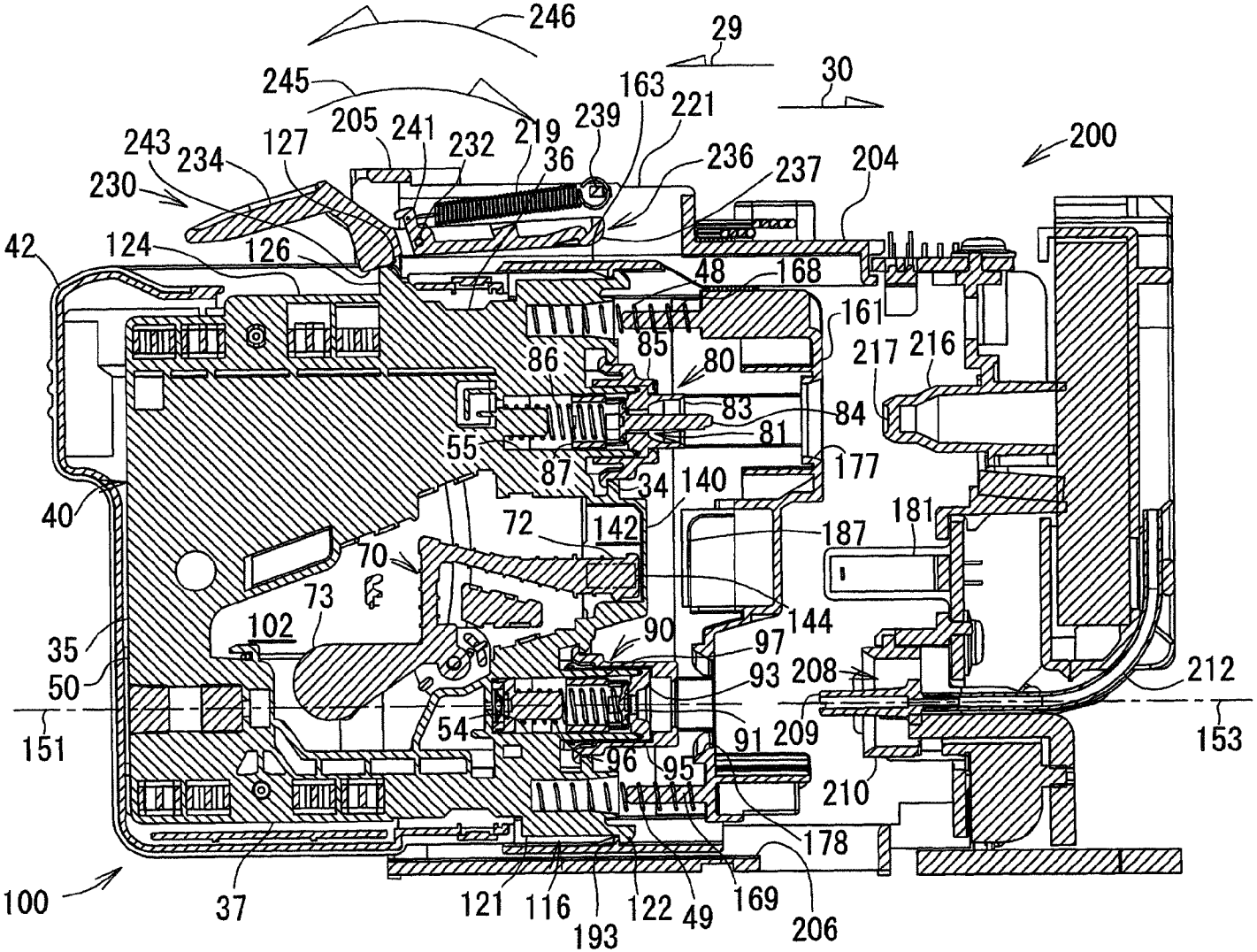
FIG. 10 is a cross-sectional view illustrating the removal of the ink cartridge from the cartridge mounting portion taken along the line VII-VII.

FIG. 1 is a perspective view illustrating the external configuration of an ink supply device 200. FIG. 1 shows a state (inserted state) in which an ink cartridge 100 is inserted into the ink supply device 200. FIGS. 2A and 2B are perspective views illustrating the external configuration of the ink cartridge 100. Specifically, FIG. 2A is a perspective view illustrating a slider 41 disposed at a first position, and FIG. 2B is a perspective view illustrating the slider 41 disposed at a second position. FIGS. 3A and 3B are side views illustrating the ink cartridge 100. Specifically, FIG. 3A is a side view illustrating the slider 41 disposed at the first position, and FIG. 3B is a side view illustrating the slider 41 disposed at the second position. FIG. 4 is a cross-sectional view taken along the line IV-IV of FIG. 2A. FIG. 5 is a perspective view illustrating the configuration of the cartridge mounting portion 202. FIG. 6 is a plan view illustrating the cartridge mounting portion 202. FIG. 7 is a cross-sectional view taken along the line VII-VII of FIG. 6. FIGS. 8 to 10 are cross-sectional views schematically illustrating the insertion of the ink cartridge 100 into the cartridge mounting portion 202. FIG. 8 shows the insertion of the ink cartridge 100, FIG. 9 shows the locked state of the ink cartridge 100 after insertion, and FIG. 10 shows the state of the ink cartridge 100 immediately after the ink cartridge is unlocked.

[Schematic Configuration of Ink Supply Device 200]

Next, the schematic configuration of the ink supply device 200 will be described. The ink supply device 200 is applied to, for example, an apparatus that consumes ink (hereinafter, referred to as an 'ink consuming apparatus'), such as an ink-jet printer. The ink supply device 200 may be formed integrally with the ink consuming apparatus. For example, an opening that can be closed up or opened by a cover is formed in a case of the ink consuming apparatus, and the ink supply device 200 is exposed to the outside through the opening.

As shown in FIG. 1, the ink supply device 200 includes the ink cartridge 100 and the cartridge mounting portion 202. The ink ridge 100 is a cartridge type, and can be inserted into or removed from the cartridge mounting portion 202. The ink supply device 200 is configured such that four kinds of ink cartridges 100 can be inserted thereinto or removed therefrom. Each of the ink cartridges 100 stores any one of cyan, magenta, yellow, and black inks. In the ink supply device 200, color inks stored in the ink cartridges 100 inserted into the cartridge mounting portion 202 are supplied to a recording head of the ink-jet printer.

[Ink Cartridge 100]

Next, the detailed configuration of the ink cartridge 100 will be described. As shown in FIGS. 2A to 3B, the ink cartridge 100 has a substantially hexahedral shape. Specifically, the ink cartridge 100 has a substantially rectangular parallelepiped shape that has a small width (in the direction of an arrow 31) and a height (in the direction of an arrow 32) and a depth (in the direction of an arrow 33) that are larger than the width. The ink cartridge 100 is inserted into the cartridge mounting portion 202 in the direction of an arrow 30 (hereinafter, referred to as an 'insertion direction 30') in an erected state shown in FIGS. 2A to 3B, that is, with the bottom thereof facing downward and the top thereof facing upward in the drawings, and is removed in the direction of an arrow 29 (hereinafter, referred to as a 'removal direction 29'). Herein, the lower surface and the upper surface of the ink cartridge 100 are defined in the erected state shown in FIGS. 2A to 3B, if they are not particularly specified.

As shown in FIG. 4, the ink cartridge 100 includes a cartridge body 40 having ink stored therein, a slider 41, a body cover 42, and coil springs 48 and 49. The external configuration of the ink cartridge 100 is substantially formed by the slider 41 and the body cover 42. The cartridge body 40 is substantially covered by the slider 41 and the body cover 42.

The body cover 42 substantially covers the cartridge body 40. A portion of an upper surface 36 of the cartridge body 40 and a rear surface 34 of the cartridge body 40 are exposed from the body cover 42. The stopper 125 of the cartridge body 40 is exposed from the body cover. The slider 41 is provided on the front side of the body cover 42 in the insertion direction, and covers a rear portion 46 and the rear surface 34 of the cartridge body 40. The rear portion 46 of the body cover 42 means a portion of the body cover 42 disposed on the front side in the insertion direction 30.

The slider 41 can slide in the depth direction (in the direction of the arrow 33) of the ink cartridge 100 between the first position (see FIG. 2A) that is furthest away from the rear surface 34 of the cartridge body 40 and the second position (see FIG. 2B) that is closest to the rear surface 34 of the cartridge body 40. When the slider 41 is disposed at the second position, a cap 95 of an ink supply valve 90, which will be described below, protrudes from the slider 41 to the outside. When the slider 41 is disposed at the first position, the cap 95 of the ink supply valve 90 is inserted into the slider 41. The detailed configurations of the cartridge body 40, the body cover 42, and the slider 41 will be described below.

[Cartridge Body 40]

Next, the detailed configuration of the cartridge body 40 will be described. The cartridge body 40 has a substantially hexahedral shape. In this exemplary embodiment, as shown in FIG. 4, in the cartridge body 40, a surface on the front side in the insertion direction 30 is the rear surface 34, a surface on the rear side in the insertion direction 30 is a front surface 35, a surface on the upper side in the gravity direction is an upper surface 36, and a surface on the lower side in the gravity direction is a lower surface 37. The rear surface 34 and the front surface 35 are opposite to each other, and are adjacent to the upper surface 36 and the lower surface 37. In addition, two surfaces that are adjacent to all of the rear surface 34, the front surface 35, the upper surface 36, and the lower surface 37 and are opposite to each other are side surfaces. The side surfaces are not shown in FIG. 4. In the cartridge body 40, the side surfaces have the largest area.

The cartridge body 40 includes a frame 50, an arm 70, an air communicating valve 80, the ink supply valve 90, and transparent resin films (not shown). Although not shown in FIG. 4, the films are adhered to the two side surfaces of the frame 50, and a space is liquid-tightly formed by the films adhered to the frame 50. The inner space of the frame 50 serves as an ink chamber 102. Ink is injected and stored in the ink chamber 102. In this exemplary embodiment, the ink chamber 102 is formed by the frame 50 and the films, however, the present invention is not limited thereto. For example, the frame 50 may have a rectangular parallelepiped shape, and the inner space thereof may serve as the ink chamber 102.

The frame 50 is a substantially ring-shaped member forming the outer wall of the body 40. As described above, the frame 50 has a ring shape that forms the rear surface 34, the front surface 35, the upper surface 36, and the lower surface 37 of the cartridge body 40. In the frame 50, the rear surface 34, the front surface 35, the upper surface 36, and the lower surface 37 have substantially the same width (in the direction of the arrow 31 in FIG. 2). The frame 50 is formed of a translucent member, for example, a transparent or translucent resin material. The frame 50 is formed of a resin material by injection molding. Examples of the resin material include polyacetal, nylon, polyethylene, and polypropylene.

A detecting portion 140 is formed on the rear surface 34 of the frame 50. The detecting portion 140 is for visually or optically detecting the amount of ink stored in the ink chamber 102. The detecting portion 140 is formed integrally with the frame 50. Therefore, the detecting portion 140 is formed of the same material as that forming the frame. That is, the detecting portion 140 is made of a transparent or translucent resin material capable of transmitting light. The detecting portion 140 can transmit light incident from the outside. The detecting portion 140 protrudes from a middle portion of the rear surface 34 of the cartridge body 40 to the outside of the cartridge body 40. The detecting portion 140 is hollow and has a substantially rectangular parallelepiped shape. An inner space 142 of the detecting portion 140 communicates with the ink chamber 102. An indicator 72 of an arm 70 provided in the ink chamber 102 is inserted into the inner space 142.

The arm 70 is rotatably supported by a supporting member 74 in the ink chamber 102. The supporting member 74 is formed integrally with the frame 50, and includes a supporting shaft 77 that supports the arm 70. The arm 70 is a rod-shaped member that is bent in a Z-shape, and has an indicator 72, which is a flat plate, at one end thereof. The indicator 72 enters the space 142, and is moved in the vertical direction in the space 142 when the arm 70 is rotated. The indicator 72 shields light emitted from an optical sensor 181.

The arm 70 has the indicator 72 at one end and a floating portion 73 at the other end. The floating portion 73 has specific buoyancy with respect to the ink stored in the ink chamber 102. The buoyancy of the floating portion 73 is adjusted by, for example, the volume of a hollow portion formed in the floating portion 73 or a material forming the floating portion. When ink stored in the ink chamber 102 is consumed, the level of ink in the ink chamber 102 is lowered, and the floating portion 73 is moved (displaced). When the floating portion 73 is displaced, the arm 70 is rotated.

If the amount of ink in the ink chamber 102 is more than a threshold value, the floating portion 73 is moved up. When the floating portion 73 is moved up, the indicator 72 is moved down in the space 142 and is disposed at a light-shielding position (a position represented by a solid line in FIG. 4). The indicator 72 disposed at the light-shielding position shields light that is emitted from a light-emitting element of the optical sensor 181 to a radiation region 144 provided at a lower part of the detecting portion 140.

If the amount of ink in the ink chamber 102 is equal to or less than the threshold value, the floating portion 73 is moved down with a drop in the level of ink. When the floating portion 73 is moved down, the indicator 72 is moved up in the space 142 and is disposed at a light-transmitting position (a position represented by a dashed line in FIG. 4). The indicator 72 disposed at the light-transmitting position is out of the radiation region 144, and does not shield light emitted from the light-emitting element of the optical sensor 181 to the radiation region 144.

A valve accommodating chamber 55 is formed at an upper part of the rear surface 34 of the frame 50. The valve accommodating chamber 55 is a cylindrical space that extends from the rear surface 34 of the frame 50 to the inside of the frame 50. The valve accommodating chamber 55 is opened from the rear surface 34 of the frame 50. The valve accommodating chamber 55 communicates with an upper space (air layer) of the ink chamber 102 in the inner rear surface thereof. The air communicating valve 80 is accommodated in the valve accommodating chamber 55.

The air communicating valve 80 is a valve that closes or opens an air passage extending from an opening of the valve accommodating chamber 55 to the ink chamber 102. The air communicating valve 80 includes a valve body 87, a coil spring 86, a seal member 83, and a cap 85. The valve body 87 can slide in the depth direction of the cartridge body 40 in the valve accommodating chamber 55. The valve body 87 includes a cover 88 and a rod 84.

The valve body 87 slides between a position where the cover 88 contacts the seal member 83 and a position where the cover 88 is separated from the seal member 83 in the valve accommodating chamber 55. When the cover 88 contacts the seal member 83, an air communicating hole 81, which will be described below, is closed. When the cover 88 is separated from the seal member 83, the air communicating hole 81 is opened. The rod 84 protrudes from the center of the cover 88 to the outside of the frame 50 through the air communicating hole 81 substantially in the horizontal direction. The leading end of the rod 84 is positioned at the outermost side of the components provided on the rear surface 34 of the cartridge body 40.

The cap 85 is attached to the opening of the valve accommodating chamber 55 with the seal member 83 interposed therebetween. The cap 85 and the seal member 83 are provided with through holes (not shown), and the through holes communicate with each other. The through holes of the cap 85 and the seal member 83 form the air communicating hole 81 through which the inside and the outside of the valve accommodating chamber 55 communicate with each other.

The coil spring 86 is provided in the valve accommodating chamber 55, and urges the valve body 87 in the direction in which the air communicating hole is closed. That is, the coil spring 86 urges the valve body 87 in the direction in which the cover 88 is moved to the seal member 83. Therefore, in the air communicating valve 80, when no external force is applied, the coil spring 86 urges the cover 88 to close up the air communicating hole 81. When external force is applied to press the rod 84, the cover 88 of the valve body 87 is separated from the seal member 83 against the urging force of the coil spring 86, and the air communicating hole 81 is opened. In this way, the air layer of the ink chamber 102 becomes the atmospheric pressure.

A valve accommodating chamber 54 is formed at a lower part of the rear surface 34 of the frame 50. The valve accommodating chamber 54 is a cylindrical space that extends from the rear surface 34 of the frame 50 to the inside of the frame 50. The valve accommodating chamber 54 is opened from the rear surface 34 of the frame 50. The valve accommodating chamber 54 communicates with a lower space of the ink chamber 102 in the inner rear surface thereof. The ink supply valve 90 is accommodated in the valve accommodating chamber 54.

The ink supply valve 90 is a valve that closes or opens an ink passage extending from the rear surface 34 of the frame 50 to the ink chamber 102. For example, the ink supply valve 90 includes a seal member 93, a cap 95, a coil spring 96, and a valve body 97.

The cap 95 is attached to an opening of the valve accommodating chamber 54 formed in the rear surface 34 of the frame 50 with the seal member 93 interposed therebetween. The seal member 93 has a substantially cylindrical shape. A hole of the seal member 93 forms a portion of the ink supply port 91, which will be described below. The seal member 93 is formed of an elastically deformable material, such as rubber, and comes into close contact with another member to liquid-tightly seal a contact surface. In addition, the seal member 93 generates a sliding load caused by friction when another member slides. The seal member 93 is attached to the valve accommodating chamber 54 such that the axis 151 of the hole thereof is parallel to the removal direction 29 and the insertion direction 30. The diameter of the hole of the seal member 93 is slightly smaller than the outside diameter of an ink needle 209, which will be described below. Therefore, the ink needle 209 comes into pressure contact with the seal member 93 to elastically deform the seal member 93 such that the diameter of the hole of the seal member is increased.

The cap 95 is provided with a through hole (not shown). The through hole of the cap 95 is provided on the axis 151 of the hole of the seal member 93. The hole of the seal member 93 and the through hole of the cap 95 form an ink supply port 91 through which the inside and the outside of the valve accommodating chamber 54 communicate with each other in the rear surface 34 of the frame 50. When the ink cartridge 100 is inserted into the cartridge mounting portion 202, the tubular ink needle 209 (see FIG. 7) is inserted into the ink supply port 91.

The valve body 97 slides along the inner wall of the valve accommodating chamber 54 and can be displaced between an opened position where the valve body is separated from the seal member 93 and a closed position where the valve body comes into close contact with the seal member 93. The valve accommodating chamber 54 is a circular hole forming a portion of the ink chamber 102. The size of the valve accommodating chamber in the radial direction is slightly larger than the size of the valve body 97, and the length thereof in the axial direction is sufficiently long to slide the valve body 97 or to accommodate the coil spring 96. The valve body 97 has a cylindrical shape, and includes a contact wall 94 that is opposite to the seal member 93. When the contact wall 94 comes into close contact with the seal member 93, the ink supply port 91 is closed. A sufficiently large gap to allow ink to pass through is provided between the circumferential surface of the valve body 97 and the inner wall of the valve accommodating chamber 54.

The coil spring 96 is provided in the valve accommodating chamber 54, and urges the valve body 97 to the closed position. That is, the coil spring 96 urges the valve body 97 in the direction in which the valve body is moved to the seal member 93. Therefore, in the ink supply valve 90, when no external force is applied, the coil spring 96 urges the valve body 97 to come into close contact with the seal member 93 such that the ink supply portion 91 is closed. On the other hand, when the ink needle 209 is inserted into the ink supply port 91 from the outside, the leading end of the ink needle 209 presses the valve body 97, and the valve body 97 is separated from the seal member 93 against the urging force of the coil spring 96. In addition, the ink supply port 91 is liquid-tightly sealed by the outer circumferential surface of the ink needle 209. Then, ink stored in the ink chamber 102 flows to the leading end of the ink needle 209 that is positioned closer to the inside than the ink support port 91, and then discharged from the ink chamber 102 to the outside through the ink needle 209.

A spring accommodating chamber 110 is formed above the air communicating valve 80 on the rear surface 34 of the frame 50. In addition, a spring accommodating chamber 111 is formed below the ink supply valve 90 on the rear surface 34 of the frame 50. The spring accommodating chambers 110 and 111 are substantially cylindrical holes formed from the rear surface 34 of the frame 50 to the ink chamber 102. Coil springs 48 and 49 are accommodated in the spring accommodating chambers 110 and 111 respectively. Each of the spring accommodating chambers 110 and 111 is a connecting portion that connects one end of each of the coil springs 48 and 49 to the cartridge body 40. The coil springs 48 and 49 urge the slider 41 to the first position (in the insertion direction 30).

In the present invention, it is not necessary to fixedly connect an elastic member such as the coil springs 48 and 49 and the cartridge body if the urging force of the first elastic member is transmitted to the cartridge body. A coil spring may be fitted into a cylindrical hole so as to be elastically contracted therein. The positions of the spring accommodating chambers 110 and 111, or the inside diameters or the depths of the holes depend on the specifications of the springs. However, it is preferable that a pair of spring accommodating chambers 110 and 111 be vertically arranged so as to be spaced from each other in the height direction of the cartridge body 40, in order to uniformly urge the slider 41 elongated in the height direction (in the direction of the arrow 32) of the cartridge body 40 such that the slider is stably disposed relative to the cartridge body 40, as in this exemplary embodiment.

A supporting member 115 is provided on the front side of the upper surface 36 of the frame 50 in the insertion direction 30. In addition, a supporting member 116 is provided on the front side of the lower surface 37 of the frame 50 in the insertion direction 30. The supporting members 115 and 116 are formed integrally with the frame 50. The supporting members 115 and 116 are formed in hook shapes that extend in the insertion direction 30. The supporting members 115 and 116 are respectively engaged with protruding pieces 192 and 193 formed on the slider 41, and support the slider 41 so as to be slidable relative to the cartridge body 40. In this way, the slider 41 can slide without being detached from the cartridge body 40.

The supporting member 115 includes a base 118 that vertically protrudes from the upper surface 36 of the frame 50 upward and a hooking portion 119 that is formed at one end of the base 118 close to the rear surface 34. The hooking portion 119 has a hook shape that is bent upward in the insertion direction 30. The supporting member 116 includes a base 121 that vertically protrudes from the lower surface 37 of the frame 50 downward and a hooking portion 122 that is formed at one end of the base 121 close to the rear surface 34. The hooking portion 122 has a hook shape that is bent downward in the insertion direction 30. The bases 118 and 121 make it possible to guide the sliding of the slider 41 relative to the cartridge body 40 in a specific direction. The hooking portions 119 and 122 prevent the slider 41 from being detached from the cartridge body 40.

A table portion 124 is provided on the upper surface 36 of the frame 50. The table portion 124 protrudes from the upper surface 36 upward. In addition, the table portion 124 extends from a middle portion of the upper surface 36 in the depth direction (in the direction of the arrow 33) backward in the insertion direction 30, that is, toward the front surface 35 of the cartridge body 40. When the cartridge body 40 is covered with the body cover 42, the table portion 124 is exposed to the outside through an opening 128 formed in the upper surface of the body cover 42.

An engaged portion (stopper) 125 is provided on the table portion 124. The engaged portion 125 is provided at the leading end (the right side of FIG. 4) of the table portion 124 in the insertion direction 30, and protrudes from the upper surface of the table portion 124 upward. The engaged portion 125 includes a vertical wall 126 that is substantially vertical with respect to the upper surface of the table portion 124 and a rib 127 that is inclined from the top of the vertical wall 126 downward to the front side of the upper surface in the insertion direction 30 at an angle of about 45°. When the ink cartridge 100 is inserted into the cartridge mounting portion 202, the engaged portion 125 is used to look the ink cartridge 100 such that the ink cartridge 100 is not removed from the cartridge mounting portion 202. The ink cartridge 100 is locked by engagement between the engaged portion 125 and a look portion 237 (see FIG. 7) of a lock arm 230, which will be described below.

A plurality of through holes 130 are formed in the frame 50. The through holes 130 are formed in the frame 50 in the width direction (in the direction that is vertical to the plane of FIG. 6) thereof. In the frame 50, four through holes are formed in each of the upper surface 36 and the lower surface 37. Engaging claws 132 of the body cover 42 are engaged with the through holes 130 to couple the cartridge body 40 and the body cover 42.

[Slider 41 and Body Cover 42]

Next, the detailed configurations of the slider 41 and the body cover 42 will be described. As shown in FIGS. 2A to 3B, the body cover 42 is formed in the shape of a container capable of substantially accommodating the cartridge cover 40, with a portion of the rear surface 34 being exposed. The body cover 42 has a substantially parallelepiped shape corresponding to the shape of the cartridge body 40.

A step portion 43 is formed substantially at the center of the side surface of the body cover 42 in the depth direction (in the direction of the arrow 33). The side surface of the body cover 42 is divided into a front portion 47 that is close to the front surface 35 of the ink cartridge 100 and a rear portion 46 that is close to the rear surface 34 by the step portion 43. The length of the rear portion 46 is smaller than that of the front portion 47 in the width direction (in the direction of the arrow 31), which causes the side surface of the body cover 42 to be uneven. The step portion 43 is an inclined planes which is a boundary between two convex portions, and extends from the upper end of the body cover 42 to the lower end thereof in an arc shape having its center on the front surface 35 (see FIG. 4) of the cartridge body 40. The step portion 43 corresponds to the thicknesses of a left wall 165 and a right wall 166 of the slider 41.

As shown in FIGS. 2A, 2B, and 4, the opening 128 is formed in the upper surface of the front portion 47 of the body cover 42. The opening 128 is a rectangular hole having a sufficient size to expose the table portion 124 and the engaged portion 125 of the cartridge body 40. When the body cover 42 is coupled to the cartridge body 40, the table portion 124 and the engaged portion 125 are exposed to the outside through the opening 128. The upper surface of the body cover 42 is substantially continuous with the rib 127 of the engaged portion 125 exposed through the opening 128, and is substantially horizontal in the insertion direction 30. The slider 41, which will be described below, is mounted so as to cover the upper surface.

As shown in FIGS. 2A and 2B, the body cover 42 includes a pair of left and right covers 44 and 45 that are symmetric with respect to the width direction (the direction of the arrow 31). Each of the left cover 44 and the right cover 45 has a plurality of engaging claws 132 (see FIG. 4) that protrude substantially in the horizontal direction. The engaging claws 132 are engaged with the through holes 130 of the cartridge body 40 with the cartridge body 40 interposed therebetween. In this way, the cartridge body 40, the left cover 44, and the right cover 45 are integrated into one.

The slider 41 is formed in the shape of a container capable of accommodating the rear portion 46 of the body cover 42, and has a flat appearance. Specifically, the slider 41 includes a rear wall 161 corresponding to the rear surface 34 of the cartridge body 40, an upper wall 163 corresponding to the upper surface of the rear portion 46 of the body cover 42, a lower wall 164 corresponding to the lower surface of the rear portion 46, and left and right side walls 165 and 166 corresponding to both side surfaces of the rear portion 46. The rear portion 46 of the body cover 42 is accommodated in the inner space of the slider 41 surrounded by the walls.

A cutout 187 is formed in the middle of the rear wall 161 of the slider 41 in the width direction (in the direction of the arrow 31). The cutout 187 serves as a window through which the detecting portion 140 of the cartridge body 40 is exposed to the outside. The cutout 187 is formed by cutting out the side walls 165 and 166 in a rectangular shape in the width direction (in the direction of the arrow 31) such that portions of the side walls close to the rear wall 161 remain. The cutout 187 transmits light emitted from the light-emitting element of the optical sensor 181 (see FIG. 7).

As shown in FIG. 4, rods 168 and 169 are provided in the slider 41. The rods 168 and 169 protrude from the inner surface of the rear wall 161 of the slider 41 to the rear surface 34 of the cartridge body 40 substantially in the horizontal direction. The rod 168 is provided at an upper part of the rear wall 161, and the rod 169 is provided at a lower part of the rear wall 161. The coil spring 48 arranged in the spring accommodating chamber 110 of the cartridge body 40 is fitted to the rod 168, and the coil spring 49 arranged in the spring accommodating chamber 111 of the cartridge body 40 is fitted to the rod 169. When the coil springs 48 and 49 are compressed, the rods 168 and 169 are inserted into the spring accommodating chambers 110 and 111, respectively.

A sliding groove 171 is formed in the rear surface of the upper wall 163 of the slider 41. The sliding groove 171 is formed by the upper wall 163, a portion of the left side wall 165, and a portion of the right side wall 166, and has an inverted U-shape having an opened lower surface in a longitudinal sectional view. In addition, a portion of the sliding groove 171 close to the rear wall 161 is opened. In the sliding groove 171, the protruding piece 192 vertically protrudes from the rear surface of the upper wall 163 downward. Most of the supporting member 115 can slide relative to the protruding piece 192, and the hooking portion 119 of the supporting member 115 contacts the protruding piece 192. The hooking portion 119 contacts the protruding piece 192 from the side of the rear wall 161. The contact prevents the slider 41 from being detached from the cartridge body 40, and the slider 41 can slide relative to the cartridge body 40 by the base 118 such that the hooking portion 119 does not contact the protruding piece 192.

A sliding groove 172 is formed in the rear surface of the lower wall 164 of the slider 41. The sliding groove 172 is formed by the lower wall 164, a portion of the left side wall 165, and a portion of the right side wall 166, and has a U-shape having an opened upper surface in a longitudinal sectional view. In addition, a portion of the sliding groove 172 close to the rear wall 161 is opened. In the sliding groove 172, the protruding piece 193 vertically protrudes from the rear surface of the lower wall 164 upward. Most of the supporting member 116 can slide relative to the protruding piece 193, and the hooking portion 122 of the supporting member 116 contacts the protruding piece 193. The hooking portion 122 contacts the protruding piece 193 from the side of the rear wall 161. The contact prevents the slider 41 from being detached from the cartridge body 40, and the sliding of the slider 41 relative to the cartridge body 40 is guided by the base 121 in a direction such that the hooking portion 122 does not contact the protruding piece 193. Therefore, the slider 41 can slide relative to the cartridge body 40. The protruding pieces 192 and 193 are disposed at the same position in the depth direction (in the direction of the arrow 33) of the slider 41. Therefore, the slide position of the slider 41 where the hooking portion 119 contacts the protruding piece 192 is the same as the slide position of the slider 41 where the hooking portion 122 contacts the protruding piece 193.

With the slider 41 being mounted to the cartridge body 40, the slider 41 is urged by the coil springs 48 and 49 in the direction in which it is separated from the rear surface 34 of the cartridge body 40. When no external force is applied to the slider 41, the protruding pieces 192 and 193 contact the hooking portions 119 and 122, respectively, and the slider 41 is disposed at the first position shown in FIG. 3A. On the other hand, when external pressing force is applied to the slider 41 from the rear wall 161, the slider 41 slides to the second position shown in FIG. 3B against the urging force of the coil springs 48 and 49.

As shown in FIGS. 2A, 2B, and 4, an opening 177 is formed at an upper part of the rear wall 161 of the slider 41. When the slider 41 is mounted to the cartridge body 40, the height of the opening 177 corresponds to that of the air communicating valve 80. The opening 177 has a circular shape, as viewed from the rear wall 161, and has a sufficient size to allow a pressing portion 216 (see FIG. 7) provided in the cartridge mounting portion 202 to pass through. When the ink cartridge 100 is inserted into the cartridge mounting portion 202, the pressing portion 216 is inserted into the opening 177.

An opening 178 is formed at a lower part of the rear wall 161 of the slider 41. When the slider 41 is mounted to the cartridge body 40, the height of the opening 178 corresponds to that of the ink supply valve 90. The opening 178 has sufficient size and shape to allow the ink supply valve 90 to pass through. When the slider 41 is disposed at the second position, a portion of the ink supply valve 90 is exposed to the outside through the opening 178.

[Cartridge Mounting Portion 202]

Next the detailed configuration of the cartridge mounting portion 202 will be described with reference to FIGS. 5 to 7. As shown in FIG. 5, the cartridge mounting portion 202 includes a frame 204 having a substantially rectangular parallelepiped shape having an opening 207 formed in the front surface thereof. The ink cartridges 100 are accommodated in the internal space of the frame 204 through the opening 207. In this exemplary embodiment, the cartridge mounting portion 202 has a space corresponding to each ink cartridge 100. That is, four cartridge mounting portions 202 are arranged in a line in the width direction (in the left-right direction of FIG. 5), and four ink cartridges 100 corresponding to cyan, magenta, yellow, and black can be inserted into the cartridge mounting portions 202. The width direction in which the cartridge mounting portions 202 are arranged in a line is the horizontal direction that is orthogonal to the insertion direction 30 of the ink cartridge 100.

As shown in FIGS. 5 and 7, three plates 223 that partition the inner space into four longitudinal spaces are provided in the frame 204. The ink cartridges 100 are accommodated in four spaces (cartridge mounting portions 202) partitioned by the plates 223. The plates 223 are thin plates that protrude from the inner rear surface of the frame 204 to the front surface, and the front and rear surfaces of the plates 223 vertically extend in the inner space of the frame 204. The plates 223 are arranged in parallel to each other in the width direction (the left-right direction of FIG. 5) of the frame 204 at specific intervals. The gap between the inner surface of the frame 204 and the plate 223 or the gap between a pair of adjacent plates 223 corresponds to the width of the ink cartridge 100 to be inserted between the plates.

The ink cartridges 100 are inserted into the cartridge mounting portions 202, which are spaces partitioned by the frame 204 and the plates 223. The ink cartridge 100 is inserted into the cartridge mounting portion 202 from the rear surface.

Four guide grooves 206 are formed in the bottom of the frame 204. Each of the guide grooves 206 is provided between the inner surface of the frame 204 and the plate 223 or between a pair of adjacent plates 223 so as to extend in a straight line from the opening 207 of the frame 204 to the inner rear surface of the frame. The ink cartridges 100 inserted into each space of the frame 204 are guided from the opening 207 to the inner rear surface of the frame 204 by the guide grooves 206 in the insertion direction 30. The ink cartridges 100 are inserted or removed in the opposite directions. The removal direction 29 and the insertion direction 30 are opposite to each other along the guide groove 206. A direction extending from the inner rear surface of the frame 204 to the opening 207 is the removal direction 29, and a direction extending from the opening 207 of the frame 204 to the inner rear surface is the insertion direction 30.

Joints 208 are formed on the inner rear surface of the frame 204. The joints 208 are connected to the ink supply ports 91 of the ink cartridges 100 to drain ink from the ink chambers 102. Therefore, four joints 208 are provided to correspond to four ink cartridges 100 inserted into the cartridge mounting portions 202. Since four ink cartridges 100 are inserted into the frame 204 in the width direction thereof, the four joints 208 are also arranged in the width direction of the frame 204, and the height of each of the joints 208 corresponds to the height of the ink supply valve 90 of each of the ink cartridges 100 inserted into the cartridge mounting portions 202. In FIG. 5, the rightmost joint 208 is concealed by the frame 204.

Each of the joints 208 includes the ink needle 209 and a holding portion 210. The ink needle 209 is a cylindrical tube, and protrudes from the inner rear surface of the frame 204 to the front surface substantially in the horizontal direction. The axis 153 of the ink needle 209 is aligned with the removal direction 29. The outside diameter of the ink needle 209 is substantially constant in the axial direction 153, and is slightly larger than the inside diameter of the seal member 93 of the ink supply valve 90. In addition, the ink needle 209 can slide in the axial direction 153 with the outer circumferential surface thereof being liquid-tightly contacted with the circumferential surface of the hole of the seal member 93. A sliding load is generated due to friction when the ink needle slides. The leading end of the ink needle 209 is opened, and is inserted into the ink supply valve 90 of the ink cartridge 100. Then, the ink supply valve 90 is opened. The inner space of the ink needle 209 is a flow passage extending from the leading end to the base, and ink can flow through the flow passage. As shown in FIG. 7, the base of the ink needle 209 is connected to an ink tube 212 on the rear surface of the frame 204. In this way, the ink tube 212 and the ink needle 209 form an ink passage. In FIG. 7, the ink tube 212 is cut at its middle part. However, actually, the ink tube 212 extends up to an ink consuming apparatus.

The holding portion 210 is a cylindrical member that is provided on the inner rear surface of the frame 204 so as to surround the base of the ink needle 209. The axis of the holding portion 210 is substantially aligned with the axis 153 of the ink needle 209. When the ink cartridge 100 is inserted into the cartridge mounting portion 202, the cap 95 (see FIG. 2B) of the ink supply valve 90 is fitted into the holding portion 210, and the ink needle 209 is inserted into the seal member 93 (the ink supply port 91) of the ink supply valve 90.

As shown in FIG. 7, the pressing portions 216 are provided on the inner rear surface of the frame 204. The height of the pressing portion 216 corresponds to that of the air communicating valve 80 of the ink cartridge 100 inserted into the cartridge mounting portion 202. Therefore, the pressing portions 216 are provided above the joints 208. In this exemplary embodiment, four pressing portions 216 are arranged in the width direction of the frame 204. Each of the pressing portions 216 is a cylindrical member that protrudes from the inner rear surface of the frame 204 to the front surface in the horizontal direction. A concave portion 217 having a circular shape is formed at the leading end of the pressing portion 216. When the ink cartridge 100 is inserted into the cartridge mounting portion 202, the pressing portion 216 is inserted into the opening 177 of the ink cartridge 100, and the concave portion 217 contacts and presses the rod 84 of the air communicating valve 80. When the rod 84 is pressed, the air communicating valve 80 is opened, and the internal pressure of the ink chamber 102 becomes the atmospheric pressure.

As shown in FIGS. 5 and 7, the optical sensors 181 are provided on the inner rear surface of the frame 204. The positions of the optical sensors 181 in the height direction correspond to the detecting portions 140 of the ink cartridges 100 inserted into the cartridge mounting portions 202. Therefore, the optical sensor 181 is disposed above the joint 208 and below the pressing portion 216. In this exemplary embodiment, four optical sensors 181 are provided in the width direction of the frame 204 to correspond to four ink cartridges 100 inserted into the cartridge mounting portion 202. In FIG. 5, the rightmost optical sensor 181 is concealed by the frame 204. The optical sensor 181 outputs a signal for detecting whether the amount of ink in the ink chamber 102 of the ink cartridge 100 is less than a threshold value.

The optical sensors 181 are so-called photo interrupters. When light emitted from the light-emitting element is received by the light-receiving element, the optical sensor outputs an electric signal corresponding to the intensity of the received light. The light-emitting element of the optical sensor 181 emits light to a radiation region 144 of the detecting portion 140 of the ink cartridge 100, and the light-receiving element receives the light passing through the radiation region 144. The optical sensor 181 outputs an electric signal corresponding to the intensity of light received by the light-receiving element. Therefore, it is possible to determine whether the amount of ink in the ink chamber 102 is less than a threshold value on the basis of the electric signal output from the optical sensor 181.

In each of the optical sensors 181, the light-emitting element and the light-receiving element are arranged so as to face each other in the horizontal direction, and the detecting portion 140 of the ink cartridge 100 can enter an optical path from the light-emitting element to the light-receiving element. The radiation region 144 of the detecting portion 140 is located at a position corresponding to the optical path of the optical sensor 181. Therefore, the optical sensor 181 can optically detect the displacement of the indicator 72 in the detecting portion 140.

As shown in FIGS. 5 to 7, lock arms 230 and coil springs 219 are provided on the upper surface of the frame 204. The lock arm 230 is for locking the insertion state of the ink cartridge 100 into the cartridge mounting portion 202. Four lock arms 230 are arranged in the width direction of the frame 204 to correspond to four ink cartridges 100.

As shown in FIG. 7, the lock arm 230 extends from the front surface of the frame 204 to the inner rear surface thereof and is then bent in a crank shape with respect to the extension direction (the left-right direction in FIG. 7). A supporting shaft 232 is provided at a middle part of the lock arm 230 in the direction in which the lock arm extends. The supporting shaft 232 has a pin shape protruding from both ends of the lock arm 230 in the horizontal direction. Although not shown in detail in FIG. 7, a pair of bearings capable of supporting the supporting shaft 232 is formed in the vicinity of the upper surface of the frame 204, and the supporting shaft 232 is rotatably supported by the pair of bearings. In this way, the lock arm 230 is supported by the frame 204 such that it can rotate on the supporting shaft 232.

The lock arm 230 has an operating lever 234 at a first end that is disposed on the front side of the frame 204 and the lock portion 237 at a second end that is disposed on the rear side of the frame 204. The operating lever 234 protrudes from the front surface of the frame 204, and the upper surface of the operating lever 234 is formed in a concave shape corresponding to the finger. The thickness of the lock arm 230 in the width direction, that is, in the horizontal direction that is orthogonal to the insertion direction 30 of the ink cartridge 100 is smaller than that of the ink cartridge 100. Therefore, the lock arm 230 is provided within the width range in which the ink cartridge 100 is accommodated. The look portion 237 has a lower circumferential surface with respect to the extension direction, and the leading end thereof is substantially vertical to the extension direction.

In the lock arm 230, a lower corner of the crank-shaped portion close to the first end is a stopper 243 that contacts the ink cartridge 100 when the operating lever 234 is pushed down. The stopper 243 is provided between the first end and the supporting shaft 232. When the operating lever 234 is pushed down, the stopper 243 protrudes downward from an upper edge 236 of the opening 207. That is, the stopper 243 and the operating lever 234 are moved in the same direction. An upper wall 205 in the vicinity of the opening 207 of the frame 204 contacts the upper surface of the lock arm 230 to regulate the rotation range of the lock arm 230. It is noted that, a protrusion piece may be provided to the frame 204 at the position of the upper edge 236. In this case, when the operating lever 234 is pushed down, the stopper 243 contacts protruding piece, thereby regulating the rotation of the lock arm 230. That is, the rotation of the lock arm 230 may be regulated by the upper wall 205 and the upper edge 236 of the frame 204.

A coil spring 219 is provided between the lock arm 230 and the frame 204. A hooking portion 241 is provided on the crank-shaped portion of the lock arm 230 so as to protrude from the upper surface of the lock arm upward in a hook shape. The hooking portion 241 hooks one end of the coil spring 219. A hooking portion 239 that hooks the other end of the coil spring 219 protrudes from the upper surface of the frame 204 in the horizontal direction. Four hooking portions 239 are formed in the frame 204 to correspond to four lock arms 230. The coil spring 219 is provided between the lock arm 230 and the frame 204 such that both ends thereof are hooked by the hooking portions 239 and 241. The coil spring 219 extends between the lock arm 230 and the frame 204 to generate contractile force. The contractile force of the coil spring 219 causes the lock arm 230 to be rotated in the clockwise direction (in the direction of an arrow 245) of FIG. 7.

When no external force is applied to the operating lever 234, the lock arm 230 is urged by the coil spring 219 in the direction of the arrow 245, and the rotation of the lock arm 230 is regulated by the upper wall 205. Herein, this posture of the lock arm 230 is referred to as a second posture. At the second posture, the upper surface of the operating lever 234 is aligned substantially in the horizontal direction, and the lock portion 237 protrudes from the inner surface of the frame 204 downward. At the second posture, the lock portion 237 contacts the ink cartridge 100 inserted into the cartridge mounting portion 202. Specifically, at the second posture, the lock portion 237 is engaged with the engaged portion (stopper) 125 of the ink cartridge 100, and regulates the movement of the ink cartridge 100 inserted into the cartridge mounting portion 202 in the removal direction 29. When the operating lever 234 is pressed down against the contractile force of the coil spring 219, the lock arm 230 is rotated in a direction opposite to the arrow 245, and the lock portion 237 is inserted into the frame 204 (see FIG. 10). Herein, this posture of the lock arm 230 is referred to as a first posture. At the first posture, the lock portion 237 does not contact the ink cartridge 100 inserted into the cartridge mounting portion 202, and the stopper 243 contacts the ink cartridge 100 removed from the cartridge mounting portion 202.

[Insertion or Removal of Ink Cartridge 100]

Next, the insertion or removal of the ink cartridge 100 into or from the cartridge mounting portion 202 will be described. As shown in FIG. 7, when the ink cartridge 100 is not inserted into the cartridge mounting portion 202 and no external force is applied to the operating lever 234 of the lock arm 230, the lock arm 230 is maintained at the second posture by the contractile force of the coil spring 219. At the second posture, the upper surface of the operating lever 234 is aligned in the horizontal direction, and the lock portion 237 protrudes from the inner surface of the frame 204 downward. When the ink cartridge 100 is inserted into the cartridge mounting portion 202, the lock portion 237 contacts the ink cartridge 100. The stopper 243 does not contact the ink cartridge 100 inserted into the cartridge mounting portion 202. Before the ink cartridge 100 is inserted, the slider 41 is disposed at the first position by the urging force of the coil springs 48 and 49.

When the ink cartridge 100 is inserted, as shown in FIG. 8, the ink cartridge 100 is inserted into the cartridge mounting portion 202 through the opening 207 of the frame 204. The insertion direction 30 of the ink cartridge 100 is the horizontal direction. The lower surface of the ink cartridge 100 is fitted into the guide groove 206 formed in the frame 204. When the ink cartridge 100 is pressed into the cartridge mounting portion 202, the ink cartridge 100 is guided in a straight line to the cartridge mounting portion 202 in the depth direction by the guide groove 206. The axial direction 151 of the seal member 93 of the ink cartridge 100 guided by the guide groove 206 is aligned with the axial direction 153 of the ink needle 209 in the cartridge mounting portion 202.

On the upper surface of the ink cartridge 100, the lock portion 237 of the lock arm 230 contacts the upper surface 163 of the slider 41. Since the lower surface of the lock portion 237 has a circumferential surface from the extension direction, the lock portion 237 is smoothly guided to the upper surface 163 of the slider 41 by the circumferential surface. When the lock portion 237 contacts the upper surface 163, the lock arm 230 is rotated to the first posture (arrow 246) against the contractile force of the coil spring 219. When the lock arm 230 is rotated, the operating lever 234 is moved down on the front side of the cartridge mounting portion 202, and the upper surface of the operating lever 234 is inclined downward with respect to the horizontal plane. It is possible to easily view the displacement of the operating lever 234 from the front side of the cartridge mounting portion 202. The user views the inclined operating lever 234 to recognize that the ink cartridge 100 is being inserted into the cartridge mounting portion 202. During the rotation of the lock arm 230, the lock arm 230 does not become to the first posture, and the stopper 243 does not contact the ink cartridge 100.

When the ink cartridge 100 is further pressed into the cartridge mounting portion 202 in the depth direction, the pressing portion 216 is inserted into the opening 177 of the slider 41, and the rear wall 161 of the slider 41 contacts the inner rear surface of the cartridge mounting portion 202. In this case, the lock portion 237 slides from the upper wall 163 of the slider 41 to the upper surface of the body cover 42. During the sliding of the lock portion 237, the lock portion 237 is moved over a step portion corresponding to the thickness of the upper wall 163 of the slider 41. However, since the lower surface of the lock portion 237 has the circumferential surface, the lock portion 237 smoothly slides to the upper surface of the body cover 42. Even when the lock portion 237 contacts the upper surface of the body cover 42, the operating lever 234 of the lock arm 230 is maintained with the upper surface thereof inclined downward. When the rear wall 161 of the slider 41 contacts the inner rear surface of the cartridge mounting portion 202, the cutout 187 of the slider 41 enters the optical path.

When the ink cartridge 100 is further pressed into the cartridge mounting portion 202 in the depth direction after the slider 41 contacts the inner rear surface of the cartridge mounting portion 202, the coil springs 48 and 49 are elastically compressed. The contractile force of the coil springs 48 and 49 is a pressing force for pressing the ink cartridge 100. The slider 41 contacts the inner rear surface of the cartridge mounting portion 202 and stops at that position. Therefore, the body cover 42 is pressed into the cartridge mounting portion 202 while moving relative to the slider 41. As a result, the slider 41 disposed at the first position slides to the second position.

The coil springs 48 and 49 is elastically compressed when the slider 41 slides to the second position. When the slider 41 is disposed at the first position, the coil springs 48 and 49 may be elastically compressed compared with the overall length of the coil springs 48 and 49. When the slider 41 is disposed at the first position, the coil springs 48 and 49 is unnecessary to be not elastically compressed. That is, when the slider 41 is disposed at the first position, the coil springs 48 and 49 may be elastically compressed.

When the body cover 42 is moved, the cartridge body 40 is also moved, and the rod 84 of the air communicating valve 80 contacts the pressing portion 216 and is pressed against the urging force of the coil spring 86. The contractile force of the coil spring 86 is a pressing force for pressing the ink cartridge 100 into the cartridge mounting portion 202. In this way, the air communicating valve 80 is opened, and the ink chamber 102 is opened to the air such that the air layer is exposed to the atmospheric pressure. In addition, the cap 95 of the ink supply valve 90 is exposed through the opening 178 of the slider 41 and then engaged with the holding portion 210 of the joint 208, and the ink needle 209 is inserted into the ink supply port 91 against the urging force of the coil spring 96. The contractile force of the coil spring 96 is a pressing force for pressing the ink cartridge 100 into the cartridge mounting portion 202. In this course, since the axis 151 of the seal member 93 is aligned with the axis 153 of the ink needle 209, the ink needle 209 is inserted into the hole of the seal member 93 when the ink cartridge 100 is inserted into the cartridge mounting portion 202. When the ink needle 209 comes into slide contact with the seal member 93 while being inserted into the hole of the seal member 93, a sliding load is generated due to friction therebetween. The contractile force of the coil spring 96 against the sliding load is a pressing force for pressing the ink cartridge 100 into the cartridge mounting portion 202. In this way, the ink supply valve 90 is connected to the joint 208, and ink in the ink chamber 102 flows to the outside through the ink supply valve 90 and the ink needle 209.

In addition, the detecting portion 140 enters the optical path of the optical sensor 181 through the cutout 187 of the slider 41. When the slider 41 is disposed at the second position, the radiation region 144 of the detecting portion 140 enters the optical path of the optical sensor. In his state, the optical sensor 181 detects the movement of the indicator 72 of the arm 70 through the detecting portion 140.

When the cartridge body 40 is moved relative to the body cover 42, the lock portion 237 of the lock arm 230 slides on the upper surface of the body cover 42 and reaches the rib 127 of the cartridge body 40. Then, the lock portion 237 is guided by the upper surface of the rib 127 and goes over the vertical wall 126 to reach the table portion 124. With the movement of the lock portion 237, the lock arm 230 is further rotated to the first posture (arrow 246), and then rotated to the second posture (arrow 245), thereby returning to the second posture. In this way, the upper surface of the operating lever 234 becomes horizontal again. When the lock arm 230 is disposed at the second posture, the lock portion 237 comes into contact with the table portion 124. Even when the lock portion 237 goes over the vertical wall 126, the stopper 243 does not contact the ink cartridge 100.

When the body cover 42 is pressed until the slider 41 is disposed at the second position, it is difficult to further press the ink cartridge 100 into the cartridge mounting portion 202 in the depth direction. The user can perceive from the ink cartridge 100 that a resistance to the pressing force is increased and the ink cartridge 100 cannot be moved any further. When the lock arm 230 is rotated to return from the first posture to the second posture and the upper surface of the operating lever 234 returns from an inclined state to a horizontal state, the user can visually recognize that the ink cartridge 100 is completely inserted.

When the user stops pressing the ink cartridge 100 into the cartridge mounting portion 202, the slider 41 is urged to the first position by the urging force of the coil springs 48 and 49. Since the slider 41 contacts the inner rear surface of the cartridge mounting portion 202, the body cover 42 tends to be moved relative to the slider 41 and then moved from the cartridge mounting portion 202 in the removal direction 29. In the air communicating valve 80, the rod 84 is urged to the position where it protrudes toward the outside by the urging force of the coil spring 86. In this case, the valve body 87 tends to be moved to the seal member 83, that is, a closed position. Similarly, in the ink supply valve 90, the valve body 97 is urged by the coil spring 96 to press the ink needle 209 in the direction in which the ink needle is removed from the ink supply valve 90. In this case, the valve body 97 tends to be moved to the seal member 93, that is, a closed position.

The cartridge body 40 of the ink cartridge 100 is urged to move from the cartridge mounting portion 202 in the removal direction 29 by the urging force of the coil springs 48, 49, 86, and 96. However, since the lock portion 237 of the lock arm 230 disposed at the second posture is engaged with the vertical wall 126 of the engaged portion (stopper) 125, the movement of the cartridge body 40 in the removal direction 29 is prevented. In this way, the ink cartridge 100 is locked in the inserted state against the urging force of the coil springs 48, 49, 86, and 96. As described above, the tip surface of the lock portion 237 is a substantially vertical surface. Therefore, when the lock portion contacts the vertical wall 126, the lock portion does not move to the upper end of the vertical wall 126.

When ink is supplied from the ink supply device 200 to an ink consuming apparatus, such as a recording head of an ink-jet printer, and ink in the ink cartridge 100 is consumed, the level of ink in the ink chamber 102 is gradually lowered. If the amount of ink in the ink chamber 102 is equal to less than a threshold value, as described above, the floating portion 73 is moved down, and the arm 70 is rotated at an angle corresponding to the movement of the floating portion. When the arm 70 is rotated, the indicator 72 is moved up in the detecting portion 140. When the indicator 72 is moved up to be out of the optical path of the optical sensor 181, the detection signal of the optical sensor 181 varies. A control unit of the ink supply device 200 or the ink consuming apparatus determines that the remaining amount of ink in the ink chamber 102 is less than a threshold value on the basis of the output of the optical sensor 181. And the control unit starts to count the amount of ink discharged from the recording head. If it is determined that a specific amount of ink is consumed thereafter, the control unit determines that no ink in the ink cartridge 100 remains, and controls a display device to display information indicating that the ink cartridge 100 needs to be replaced. The user recognizes from the information displayed on the display device that it is necessary to replace the ink cartridge 100. The control unit may control the display device to display information indicating the replacement of the ink cartridge 100 when it is determined that the remaining amount of ink is less than the threshold value on the basis of the output of the optical sensor 181.

When the ink cartridge 100 is replaced, the operating lever 234 of the lock arm 230 is pressed down in order to unlock the ink cartridge 100. Then, the lock arm 230 is rotated about the supporting shaft 232 in the direction of the arrow 246, and the lock arm 230 is displaced from the second posture to the first posture. When the lock arm 230 takes the first posture, the lock portion 237 is separated from the table portion 124 and then moved above the vertical wall 126. That is, the lock portion 237 is separated from the engaged portion 125. In addition, the stopper 243 is positioned so as to contact the upper surface of the ink cartridge 100 sprung out from the cartridge mounting portion 202.

When the lock portion 237 is moved above the vertical wall 126, the movement of the cartridge body 40 in the removal direction 29 is not regulated. Therefore, the cartridge body 40 is moved in the removal direction 29 by the urging forces of the coil springs 48 and 49 and the coil springs 86 and 96, and the slider 41 relatively slides from the second position to the first position. When the cartridge body 40 is moved, in the air communicating valve 80, the rod 84 is moved in the direction in which it protrudes toward the outside, and the air communicating valve 80 is closed. In the ink supply valve 90, the ink needle 209 is removed from the ink supply port 91, and the valve body 97 closes up the ink supply port 91. Further, the cap 95 is removed from the holding portion 210 of the joint 208.

When the slider 41 slides to the first position and the urging forces of the coil springs 48 and 49 and the coil springs 86 and 96 are applied to the cartridge body 40, a portion of the ink cartridge 100 tends to be sprung out from the cartridge mounting portion 202 in the removal direction by inertia force caused by the movement of the cartridge body 40.

The axis 151 of the hole of the seal member 93 forming the ink supply port 91 and the axis 153 of the ink needle 209 are aligned with the removal direction 29 of the ink cartridge 100. Therefore, when the cartridge body 40 is moved in the removal direction 29, the seal member 93 is moved in the removal direction 29 while coming into slide contact with the ink needle 209. The slide contact between the seal member 93 and the ink needle 209 generates friction, and the friction serves as a load against the urging force of each of the coil springs 48, 49, 86, and 96.

Therefore, even when the stopper 125 is disengaged from the lock portion 237 with the urging force of each of the coil springs 48, 49, 86, and 96 being applied to the cartridge body 40 and the body cover 42, the cartridge body 40 and the body cover 42 are not forcibly moved in the removal direction 29. That is, the cartridge body 40 and the body cover 42 are slowly moved in the removal direction 29 due to a load caused by the sliding friction between the seal member 93 and the ink needle 209 until the ink needle 209 is completely removed from the ink supply port 91. When the ink needle 209 is completely removed from the ink supply port 91, the urging force of the coil spring 96 is not applied, and the urging force of each of the coil springs 48, 49, and 86 is also reduced until the ink needle 209 is completely removed from the ink supply port 91. Therefore, the cartridge body 40 and the body cover 42 are not sprung out any further.

Additionally, when the lock arm 230 takes the first posture, the stopper 243 protrudes from the upper edge 236 of the opening 207, and is moved to a position where it contacts the upper surface of the ink cartridge 100. The rotating speed of the lock arm 230 about the supporting shaft 232 from the second posture to the first posture depends on the speed at which the user presses down the operating lever 234. It is possible to contact the stopper 243 with the upper surface of the body cover 42 or the upper surface of the slider 41 before the ink cartridge 100 is completely sprung out from the cartridge mounting portion 202, by adjusting the speed at which the ink cartridge 100 is sprung out from the opening 207 of the cartridge mounting portion 202, with respect to the rotating speed of the lock arm 230, on the basis of the urging forces of the coil springs 48 and 49, the sliding range of the slider 41, and the operation of the user. In FIG. 10, the stopper 243 is engaged with the engaged portion 125 of the cartridge body 40 to regulate the spring-out of the ink cartridge 100 in the removal direction 29. However, the position where the stopper 243 contacts the upper surface of the ink cartridge 100 depends on, for example, the operating speed of the operating lever 234. It is preferable that the stopper 243 contact the ink cartridge 100 in the position range from a position where the urging force of the coil springs 48 and 49 is not applied to the ink cartridge 100 in the cartridge mounting portion 202 to a position where the ink cartridge 100 is completely removed from the opening 207.

When the urging force of the coil springs 48 and 49 is not applied to the ink cartridge 100 in the cartridge mounting portion 202, the ink cartridge 100 is not moved any further by the urging force even when the stopper 243 is separated from the ink cartridge 100. When the ink cartridge 100 is not completely removed from the cartridge mounting portion 202 by the remaining urging force of the coil springs 48 and 49 after the stopper 243 is separated from the ink cartridge 100, the same effect as that in this exemplary embodiment is obtained.

As described above, when the lock arm 230 is displaced form the second posture to the first posture, the lock portion 237 is disengaged (separated) from the engaged portion 125 of the ink cartridge 100 and the stopper 243 contacts the ink cartridge 100 again. When the stopper 243 contacts the ink cartridge 100 again, the movement of the ink cartridge 100 sprung out from the cartridge mounting portion 202 is regulated. In this way, the ink cartridge 100 is moved from the cartridge mounting portion 202 in the removal direction 29, and then stops without being completely sprung out from the cartridge mounting portion 202.

When the operating lever 234 is released after the ink cartridge 100 stops, the lock arm 230 is rotated about the supporting shaft 232 from the first posture to the second posture by the contractile force of the coil spring 219. Then, the stopper 243 is separated from the ink cartridge 100, and the ink cartridge 100 is moved in the removal direction 29. In this case, since the slider 41 is disposed at the first position, the slider 41 is not moved any further by the urging force of the coil springs 48 and 49. Therefore, even when the stopper 243 is separated, the ink cartridge 100 stops with a portion of the body cover 42 of the ink cartridge 100 being sprung out from the opening 207 of the cartridge mounting portion 202. Then, the user holds both sides of a portion of the body cover 42 sprung out from the opening 207 and takes out it from the cartridge mounting portion 202. In this way, the ink cartridge 100 is removed from the cartridge mounting portion 202.

[Operations and Effects of this Exemplary Embodiment]

As described above, according to the ink supply device 200 of this exemplary embodiment, the coil springs 48, 49, 86, and 96 urge the cartridge body 40 and the body cover 42 of the ink cartridge 100 inserted into the cartridge mounting portion 202 in the removal direction 29, and sliding friction is generated by the slide contact between the ink needle 209 and the seal member 93 of the ink supply valve 90. Therefore, when the lock portion 237 is disengaged from the stopper 125 and the cartridge body 40 and the body cover 42 are moved in the removal direction 29, the sliding friction between the seal member 93 and the ink needle 209 against the urging force of the coil springs 48, 49, 86, and 96 serves as a load. In this way, the unlocked ink cartridge 100 is not forcibly sprung out from the cartridge mounting portion 202 in the removal direction 29. As a result, it is possible to prevent ink droplets from being scattered when the ink cartridge 100 is removed.

Additionally, as described above, according to the ink supply device 200 of this exemplary embodiment, when the user operates the operating lever 234 to displace the lock arm 230 from the second position to the first position, the ink cartridge 100 is moved in the cartridge mounting portion 202 in the removal direction 29 by the urging force of the coil springs 48 and 49, and the stopper 243 contacts the ink cartridge 100. Then, the ink cartridge 100 stops without being completely sprung out from the cartridge mounting portion 202. Therefore, when the ink cartridge 100 is taken out from the cartridge mounting portion 202, the ink cartridge 100 is appropriately sprung out from the cartridge mounting portion 202. As a result, it is easy to take out the ink cartridge, and it is possible to prevent the ink cartridge 100 from being excessively sprung out from the cartridge mounting portion 202.

The stopper 243 is provided at the first end of the lock arm 230. Therefore, when the lock arm 230 is displaced such that the lock portion 237 is disengaged from the engaged portion 125 of the cartridge body 40, the stopper 243 is moved to contact the ink cartridge 100. When the user operates the operating lever 234 in one direction to change the position of the lock arm 230 from the second posture to the first posture, the lock portion 237 and the stopper 125 can be operated at once.

The lock arm 230 is rotated about the supporting shaft 232 between the operating lever 234 (first end) and the lock portion 237 (second end) to be displaced from the first posture to the second posture. Therefore, when the operating lever 234 is operated to rotate the lock arm 230 from the second posture to the first posture, the lock portion 237 is disengaged from the engaged portion 125 of the cartridge body 40, and the stopper 125 provided at the first end is moved to contact the ink cartridge 100. As a result, it is possible to easily change the posture of the lock arm 230.

The lock arm 230 is urged to the second posture by the coil spring 219. When the operating lever 237 is not operated, the lock arm 230 is maintained at the second posture. When the operating lever 237 is operated, the lock arm 230 is displaced to the first posture. Therefore, when the user stops operating the operating lever 237 after the stopper 243 contacts the ink cartridge 100 again to prevent the spring-out of the ink cartridge 100, the lock arm 230 is displaced to the second posture, and the stopper 243 is separated from the ink cartridge 100. Then, the ink cartridge 100 can be removed from the cartridge mounting portion 202. As a result, operability improves.

The stopper 243 contacts the ink cartridge 100 in the position range from a position where the urging force of the coil springs 48 and 49 is not applied to the ink cartridge 100 to a position where the ink cartridge 100 is completely removed from the opening 207. Therefore, even when the lock arm 230 is rotated from the first position to the second position after the stopper 243 contacts the ink cartridge 100 to prevent the spring-out of the ink cartridge 100, the ink cartridge 100 is not sprung out from the cartridge mounting portion 202 any further.

In the present invention, the shape of the ink cartridge is not limited to the shape of the ink cartridge 100 according to the above-described exemplary embodiment. In the present invention, the directions of in which the ink cartridge is inserted and removed into and from the cartridge mounting portion are not limited to the removal direction 29 and the insertion direction 30 opposite to each other along the horizontal direction in this exemplary embodiment. However, for example, any directions, such as the horizontal direction, the vertical direction, and an inclined direction, may be used as an insertion direction and a removal direction. Further, in the present invention, the contact of the stopper with the ink cartridge includes any contact state locking (regulating) the movement in the removal direction such as pressure contact, engagement and the like.

In the above-described exemplary embodiment, the ink cartridge 100 includes the cartridge body 40 and the slider 41. The coil springs 48 and 49 interposed between the cartridge body and the slider urge the ink cartridge to the removal direction. The elastic member which urges the ink cartridge may be provided in the cartridge mounting portion 202. For example, the ink cartridge 100 may not include the slider 41, and an elastic member, such as a spring that urges the ink cartridge 100 in the removal direction 29, may be provided in the cartridge mounting portion 202. Alternatively, no elastic member may be provided in the cartridge mounting portion 202, and the coil spring 86 of the air communicating valve 80 or the coil spring 96 of the ink supply valve 90 may serve to urge the ink cartridge 100 to the removal direction.

All of the coil springs 48, 49, 86, and 96 according to this exemplary embodiment are not necessarily needed for urging the ink cartridge to the removal direction, but any one of the coil springs may be used for urging the ink cartridge to the removal direction.

In this exemplary embodiment, the slide contact between the ink needle 209 and the seal member 93 of the ink supply valve 90 generates a load against the urging force of the coil springs 48, 49, 86, and 96. However, for example, the load against the urging force of the coil springs 48, 49, 86, and 96 may be generated by sliding friction between other members, such as the slide contact between the pressing portion 216 and the seal member 83 of the air communicating valve 80 or the slide contact between the slider 41 and the cover body 42.

What is claimed is:

1. An ink supply device comprising: an ink cartridge which includes an ink chamber for storing ink and an engaged portion; a cartridge mounting portion which includes an opening through which the ink cartridge is insertable in a first direction and removable in a second direction and which is configured to accommodate therein the ink cartridge; a first elastic member which urges the ink cartridge accommodated in the cartridge mounting portion to the second direction; and a lock member which is engaged with the engaged portion of the ink cartridge accommodated in the cartridge mounting portion to regulate a movement of the ink cartridge to the second direction; wherein the lock member includes: a lock arm including an operating lever provided at a first end thereof, and a lock portion provided at a second end thereof and being engaged with the engaged portion; a supporting mechanism which movably supports the lock arm between a first posture in which the lock portion is disengaged from the engaged portion and a second posture in which the lock portion is engaged with the engaged portion; and a stopper which is provided in the lock arm and contacts the ink cartridge moved in the second direction by the first elastic member when the lock arm takes the first posture: wherein the lock arm is rotatable about a shaft provided between the first end and the second end to be movable between the first posture and the second posture; and wherein the stopper is provided between the first end and the shaft in the lock arm.

2. The ink supply device according to claim 1;

wherein the lock member further includes a second elastic member which urges the lock arm to the second posture.

3. The ink supply device according to claim 1;

wherein the stopper is configured to contact the ink cartridge in a position range from a position where an urging force of the first elastic member is not applied to the ink cartridge to a position where the ink cartridge is not completely removed from the opening.

4. The ink supply device according to claim 1;

wherein the first elastic member includes one end connected to the ink cartridge and is elastically compressed when the ink cartridge is accommodated in the cartridge mounting portion.

5. The ink supply device according to claim 1;

wherein the first direction is opposite to the second direction.

6. An ink supply device comprising:

an ink cartridge which includes an ink chamber for storing ink, an engaged portion; and a friction member;

a cartridge mounting portion to which the ink cartridge is removably inserted and configured to accommodate therein the ink cartridge;

a contact member which is provided in the cartridge mounting portion, and which comes into slide contact with the friction member of the ink cartridge inserted into the cartridge mounting portion so that the ink cartridge is movable in a removal direction;

an elastic member which urges the ink cartridge inserted into the cartridge mounting portion to the removal direction; and a lock member which is movable between a first posture in which the ink cartridge inserted into the cartridge mounting portion is removable in the removal direction and a second posture in which the lock member is engaged with the engaged portion to regulate a movement of the ink cartridge to the removal direction against an urging force of the elastic member;

wherein the friction member generates a sliding friction with the contact member of the cartridge mounting portion;

wherein the friction member includes a cylindrical member of a first port through which ink in the ink chamber flows to outside; and wherein the contact member includes an ink flow tube which is inserted into the cylindrical member.

7. The ink supply device according to claim 6;

wherein the ink cartridge further includes a. first valve body which comes into contact with and separates from the cylindrical member to be movable between an opened position which opens the first port and a closed position which closes the first port; and wherein the elastic member urges the first valve body to the closed position.

8. The ink supply device according to claim 6;

wherein the ink cartridge includes:

a body which includes the ink chamber and the engaged portion; and a slider which is provided at a front of the body in an insertion direction opposite to the removal direction and is movable between a first position which is spaced from a front portion of the body in the insertion direction and a second position which is closer to the body than the first position; and wherein the elastic member is provided in the ink cartridge and urges the slider to the first position.

9. The ink supply device according to claim 6;

wherein the ink cartridge further includes:

a second port which communicates with an air layer of the ink chamber;

a second valve body which is movable between an opened position which opens the second port and a closed position which closes the second port; and wherein the elastic member is provided in the ink cartridge and urges the second valve body to the dosed position.

10. An ink cartridge accommodating device comprising:

a cartridge accommodating portion to which an ink cartridge is removably inserted, the ink cartridge including an engaged portion; and a lock member including:

a shaft;

a lock arm rotatably supported by the shaft, the lock arm including:

an operating lever provided at a first end thereof;

a lock portion provided at a second end thereof and engaged with the engaged portion; and a stopper;

wherein the shaft is provided between the first end and the second end;

wherein the stopper is provided between the first end and the shaft; and wherein the lock arm is rotatable between a first posture in which the lock portion is disengaged from the engaged portion and the stopper contacts a portion of the ink cartridge and a second posture in which the lock portion is engaged with the engaged portion.

11. The ink supply device according to claim 1;

wherein the ink cartridge has a contact portion;

wherein the stopper is configured not to contact the contact portion when the ink cartridge is accommodated in the cartridge mounting portion while the lock member engaging the engagement portion; and wherein the stopper is configured to contact the contact portion at a predetermined position until the ink cartridge is completely removed from the opening.

12. The ink supply device according to claim 10;

wherein, when the ink cartridge is accommodated in the cartridge accommodating portion while the lock arm is at the second posture and the lock portion is engaged with the engaged portions, the stopper does not contact the portion of the ink cartridge.

13. The ink supply device according to claim 6;

wherein the cartridge mounting portion includes a holding portion which has a cylindrical shape to surround the contact member; and wherein the ink cartridge includes a cap which surrounds the friction member and is configured to engage with the holding portion.

* * * * *